US010133211B2

(12) United States Patent
Yomoda

(10) Patent No.: US 10,133,211 B2
(45) Date of Patent: Nov. 20, 2018

(54) DEVELOPER SUPPLYING CONTAINER AND DEVELOPER SUPPLYING SYSTEM

(71) Applicant: CANON KABUSHIKI KAISHA, Tokyo (JP)

(72) Inventor: Nobuyuki Yomoda, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/238,896

(22) Filed: Aug. 17, 2016

(65) Prior Publication Data

US 2017/0060029 A1 Mar. 2, 2017

(30) Foreign Application Priority Data

Aug. 31, 2015 (JP) ..... 2015-169916

(51) Int. Cl.
*G03G 15/08* (2006.01)

(52) U.S. Cl.
CPC ..... *G03G 15/0886* (2013.01); *G03G 15/0872* (2013.01)

(58) Field of Classification Search
CPC ... G03G 2215/0692; G03G 2215/0663; G03G 2215/066; G03G 15/087; G03G 15/0872; G03G 15/0886; G03G 15/0865; G03G 15/0877; G03G 2215/067; G03G 15/0867; G03G 2215/0668
See application file for complete search history.

(56) References Cited

U.S. PATENT DOCUMENTS

| | | | | |
|---|---|---|---|---|
| 9,442,422 | B1 * | 9/2016 | Terakado | G03G 15/0865 |
| 2007/0140746 | A1 * | 6/2007 | Kaiho | G03G 15/0872 399/262 |
| 2007/0269237 | A1 * | 11/2007 | Sato | G03G 15/0875 399/260 |
| 2008/0013984 | A1 | 1/2008 | Mihara | |

(Continued)

FOREIGN PATENT DOCUMENTS

| | | | |
|---|---|---|---|
| EP | 2 060 954 | A1 | 5/2009 |
| JP | 2010-032670 | A | 2/2010 |
| JP | 2013-140408 | A | 7/2013 |

*Primary Examiner* — Clayton E Laballe
*Assistant Examiner* — Ruifeng Pu
(74) *Attorney, Agent, or Firm* — Fitzpatrick, Cella, Harper & Scinto

(57) ABSTRACT

A shutter has two engagement portions projecting from a shielding portion, and extending in an attachment direction of the shutter. A lock portion is formed elastically deformably, and a lock claw portion is provided on a tip portion of each lock portion. The lock claw portion is projected toward an outer side in a width direction intersecting an attachment direction of the shutter. Two different inclined surfaces, a second inclined surface and a first inclined surface, are formed on a tip side of the lock claw portion. According to this arrangement, it becomes possible to realize both weakened sliding resistance between the second inclined surface and the attachment contact portion by minimizing an inclination angle of the second inclined surface, and increased sliding resistance between the first inclined surface and a return contact portion by maximizing the inclination angle of the first inclined surface. Thereby, both shutter attachment and return of the shutter to the initial position can be realized.

14 Claims, 18 Drawing Sheets

(56) References Cited

U.S. PATENT DOCUMENTS

| | | | | |
|---|---|---|---|---|
| 2012/0195645 | A1* | 8/2012 | Takami | G03G 15/0886 399/262 |
| 2013/0243491 | A1* | 9/2013 | Nodera | G03G 15/0886 399/260 |
| 2014/0064794 | A1* | 3/2014 | Takahashi | G03G 15/0886 399/262 |
| 2014/0153974 | A1* | 6/2014 | Jimba | G03G 15/0879 399/262 |
| 2014/0376968 | A1* | 12/2014 | Yamamoto | G03G 15/0867 399/258 |
| 2015/0043944 | A1* | 2/2015 | Yamamoto | G03G 21/1676 399/258 |
| 2016/0004185 | A1* | 1/2016 | Enokuchi | G03G 15/087 399/262 |
| 2016/0004187 | A1 | 1/2016 | Yomoda et al. | |

* cited by examiner

DEVELOPER SUPPLYING CONTAINER AND DEVELOPER SUPPLYING SYSTEM

BACKGROUND OF THE INVENTION

Field of the Invention

The present invention relates to a developer supplying system and a developer storage container adopting an electro-photographic technique, such as a printer, a copying machine, a facsimile or a multifunction device.

Description of the Related Art

Developers are used in image forming apparatuses utilizing an electro-photographic technique. Since the image forming apparatus utilizes a developer to perform image forming, the developer is supplied and consumed to develop images during the image forming process. Therefore, in the image forming apparatus, a new developer is supplied through a developer supplying device (hereinafter simply referred to as a supplying device). A developer supplying container storing a developer to be supplied (hereinafter simply referred to as a supplying container) is provided insertably to and removably from the supplying device. A shutter is provided on an outlet port of the supplying container, to prevent leakage of the developer from the supplying container (US2014153974A1).

The shutter is attached to the supplying container in advance. The shutter has a pair of lock portions projected toward a direction of attachment to the supplying container and having an inclined surface formed on a tip portion thereof, so that the shutter can be attached easily to the supplying container when forming the supplying container. During attachment of the shutter to the supplying device, the shutter can be mounted smoothly to the supply container by having the lock portions elastically deform in response to the inclined surfaces of the lock portions being abutted against contact portions of the supplying container.

In a state where the supplying container having the shutter attached is mounted to the supplying device, the shutter is fixed to the supplying device by having the lock portions engage with a locked portion of the supplying device in midway of insertion to the supplying device, and thereafter, the supplying container moves relatively with respect to the shutter. The supplying container is moved to a position where the shutter is opened and the outlet port is exposed. Thereby, the outlet port of the supplying container is communicated with a receive port of the developing unit, and supplying of the developer from the supplying container to the developing unit is enabled. On the other hand, in a case where the supplying container is detached from the supplying device, the shutter must be returned to an initial position corresponding to a state where the supplying container is not yet mounted to the supplying device. The inclined surfaces of the lock portions are also utilized when returning the shutter to the initial position.

In the prior art, as described, inclined surfaces of the lock portions are utilized to realize "shutter attachment" when attaching the shutter to the supplying container, and "return of the shutter to the initial position" when detaching the supplying container from the supplying device. Therefore, it is necessary that the inclined surface of each lock portion is formed with an arbitrary inclination angle. Now, in order to realize smooth shutter attachment, it is preferable to set the inclination angle of the inclined surfaces as small as possible, to weaken a sliding resistance between the inclined surfaces and the contact portions during shutter attachment. On the other hand, in order to return the shutter infallibly to the initial position, it is preferable to set the inclination angle of the inclined surfaces as large as possible, to increase the sliding resistance between the inclined surfaces and the contact portions during detachment of the supplying container. In the prior art, the inclination angle is adjusted to satisfy these contradictory requests as much as possible to form the inclined surfaces. However, the adjustment of the inclination angle is performed only within a restricted range, and it was not possible to satisfy both the above-described requests.

In consideration of the above-described problems, the present invention provides an image forming apparatus, a developer supplying container and a shutter, capable of realizing both "shutter attachment" and "return of the shutter to the initial position" by a simple configuration.

SUMMARY OF THE INVENTION

The present invention provides a developer supplying container and a developer supplying system realizing both shutter attachment and movement of the shutter to a predetermined position in a case where the developer supplying container is drawn out. The present invention provides a developer supplying container including a storage portion configured to store a developer, an opening configured to discharge the developer in the storage portion, a shutter configured to open and close the opening, an engagement portion, provided on the shutter, configured to be capable of moving in a width direction intersecting an inserting direction of the shutter to the developer supplying container, a contact portion, provided on the storage portion, configured to move the engagement portion in the width direction by abutting against the engagement portion, so as to mount the shutter to the storage portion, in a state where the shutter is moved in the inserting direction along with a mounting operation of the shutter to the storage portion, a first inclined surface, provided on the engagement portion, configured to engage to move the shutter in a direction opposite to the inserting direction, and a second inclined surface provided on the engagement portion, having an angle with respect to the inserting direction smaller than an angle of the first inclined surface, and configured to abut against the contact portion along with a movement of the shutter in the inserting direction.

Further features of the present invention will become apparent from the following description of exemplary embodiments with reference to the attached drawings.

DESCRIPTION OF THE EMBODIMENTS

Image Forming Apparatus

Hereafter, an image forming apparatus according to the present embodiment will be described. At first, the outline of the image forming apparatus will be described, and thereafter, a developer supplying device and a developer supplying container mounted to the image forming apparatus will be described.

The image forming apparatus adopting an electro-photographic system as an image forming apparatus mounting a developer supplying device to which a developer supplying container, so-called a toner cartridge, according to the present embodiment is inserted removably will be described with reference to FIG. 1.

Figure 1:
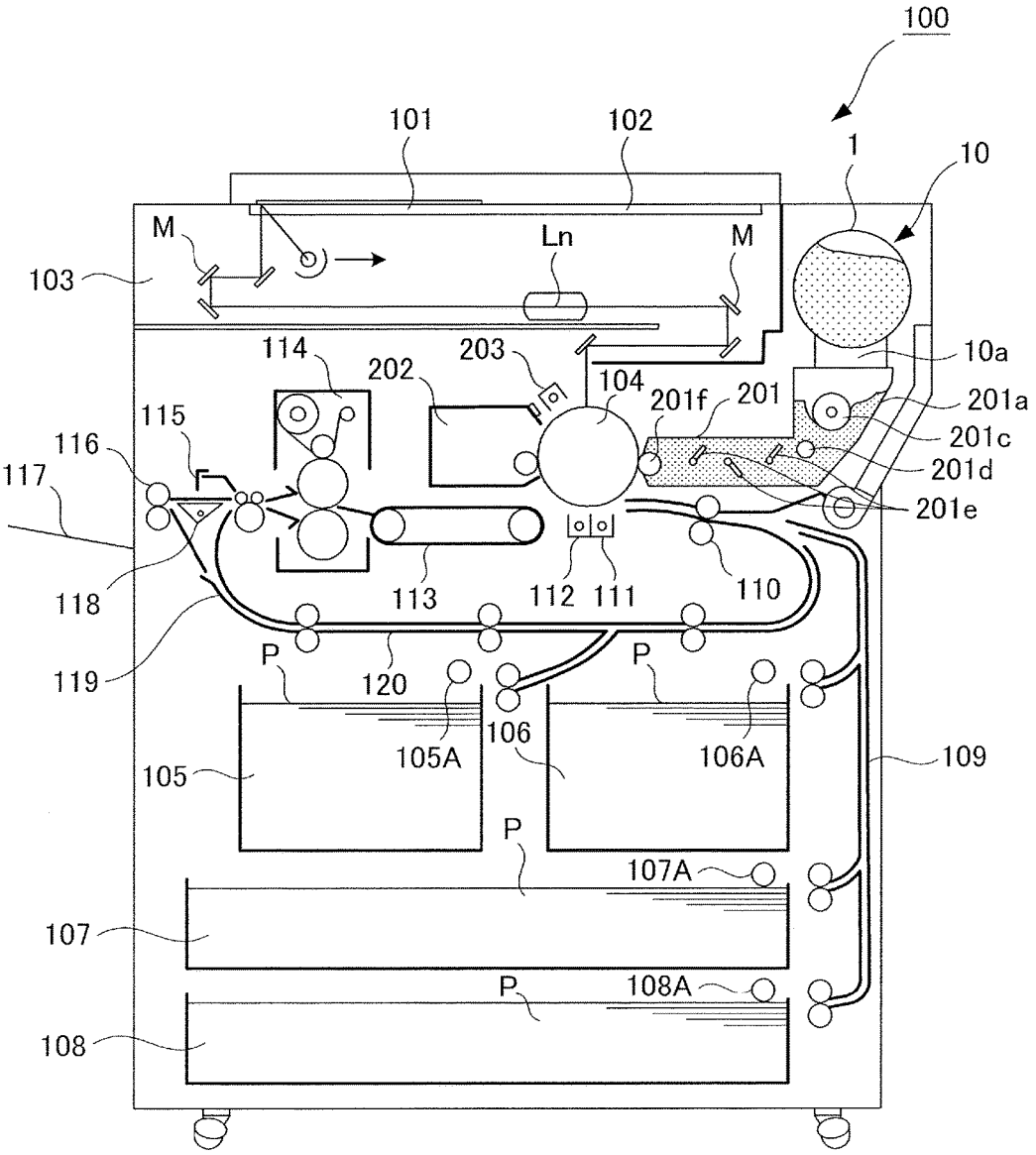
FIG. 1 is a cross-sectional view of an image forming apparatus according to a present embodiment.

In FIG. 1, 100 denotes an image forming apparatus body, hereinafter referred to as an apparatus body. Reference number 101 denotes a document, which is placed on a platen glass 102. Then, an optical image corresponding to an image information of the document is formed on an electro-photographic photoreceptor 104, hereinafter referred to as photoreceptor, via multiple mirrors M and a lens Ln of an optical unit 103, so as to form an electrostatic latent image. The electrostatic latent image is visualized using a toner, i.e., one-component magnetic toner, as developer in the form of a dry powder through a dry developing unit, i.e., one-component developing unit 201*a*.

In the present embodiment, an example where a one-component magnetic toner is used as the developer supplied from the developer supplying container 1 is described, but the present embodiment is not restricted to such example, and the following arrangement can also be adopted.

Specifically, when a one-component developing unit that develops an image using a one-component nonmagnetic toner is used, the one-component nonmagnetic toner is supplied as the developer. It is also possible to use a two-component developing unit that develops an image using a two-component developer having mixed a magnetic carrier and a nonmagnetic toner, and in that case, a nonmagnetic toner is supplied as the developer. In this case, an arrangement of supplying magnetic carrier together with the nonmagnetic toner as developer can be adopted.

Reference numbers 105 through 108 refer to cassettes storing recording materials, hereinafter also referred to as sheets, P. Among the sheets P supported on the cassettes 105 through 108, a most appropriate cassette is selected based either on information entered through a liquid crystal operation unit of the copying machine by an operator, i.e., user, or on the sheet size of a the document 101. In the present description, recording material is not restricted to paper, and other materials, such as OHP sheets, can be selected and used arbitrarily.

One sheet P conveyed via feeding-separating devices 105A through 108A is conveyed through a conveyance unit 109 to a registration roller 110, and the sheet is further conveyed by synchronizing the timing of rotation of a photoreceptor 104 and scanning of an optical unit 103.

Reference number 111 refers to a transfer charger, and 112 refers to a separation charger. Here, the transfer charger 111 transfers an image formed via a developer on the photoreceptor 104 onto the sheet P. Then, the separation charger 112 separates the sheet P, onto which the developer image, i.e., toner image, has been transferred, from the photoreceptor 104.

Thereafter, the developer image is fixed onto the sheet P conveyed via a conveyance unit 113 by heat and pressure at a fixing unit 114, and in the case of a one-side copy, the sheet P is passed through a reverse discharge unit 115, and discharged via a discharge roller 116 to a discharge tray 117.

In the case of duplex copying, the sheet P is passed through the reverse discharge unit 115, and a part of the sheet P is temporarily discharged to an exterior of the apparatus by the discharge roller 116. Thereafter, at a timing where a trailing edge of the sheet P has passed a flapper 118 but still nipped by the discharge roller 116, the flapper 118 is controlled and the discharge roller 116 is rotated in reverse rotation, such that the sheet S is conveyed again into the apparatus. Further, thereafter, the sheet passes through reconveyance units 119 and 120 and reaches the registration roller 110, and then the sheet passes the same passage as in the case of the one-side copy, and is discharged onto the discharge tray 117.

In the apparatus body 100 configured as above, image forming process devices such as a developing unit 201*a*, i.e., developing means, a cleaner unit 202, i.e., cleaning means, and a primary charger 203, i.e., charging means, are disposed around the photoreceptor 104. The developing unit 201*a* develops images by attaching a developer to an electrostatic latent image formed on the photoreceptor 104 via the optical unit 103 based on the image information of the document 101. Further, the primary charger 203 is used to evenly charge a surface of the photoreceptor, so that forma desired electrostatic image can be formed on the photoreceptor 104. Further, the cleaner unit 202 removes the developer remaining on the photoreceptor 104.

Developer Supplying Device

Figure 2A:
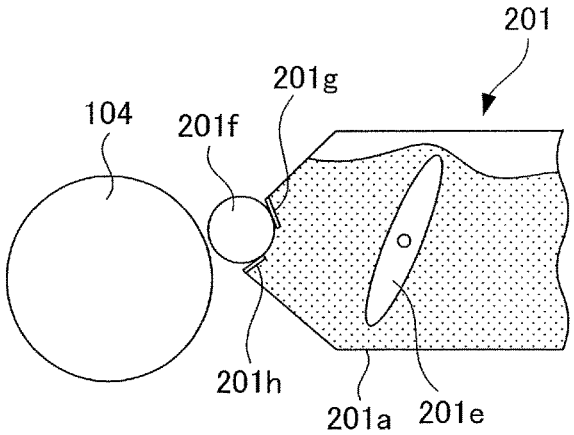
FIG. 2A is a partial cross-sectional view of a developer supplying device.
Figure 2B:
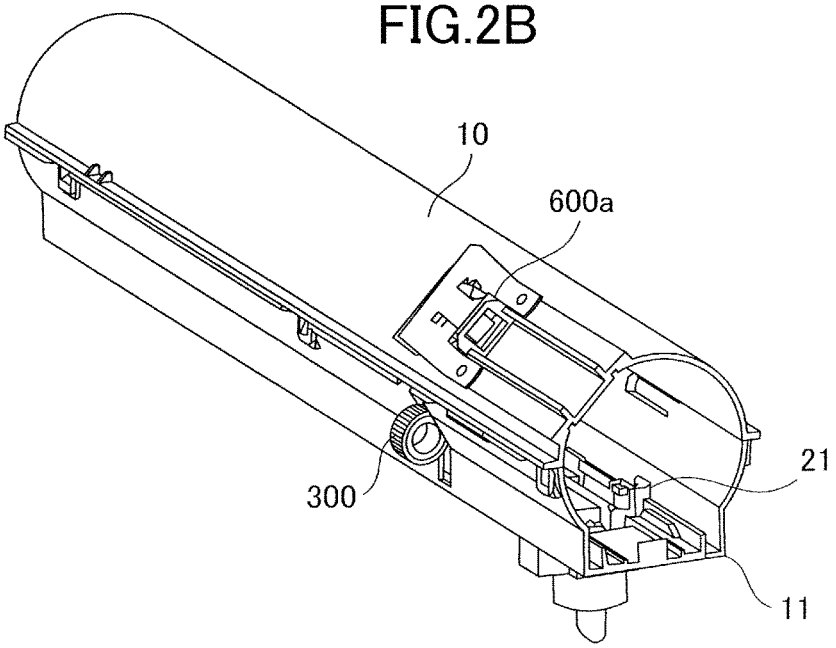
FIG. 2B is an outer perspective view of a mounting unit.
Figure 2C:
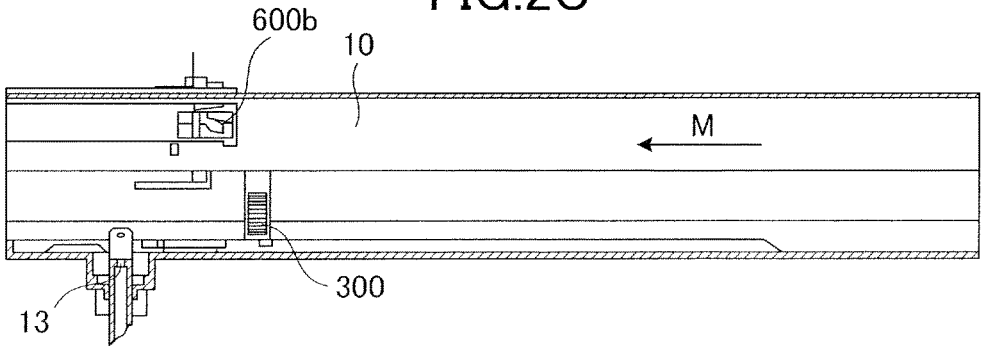
FIG. 2C is a cross-sectional view of the mounting unit.
Figure 3:
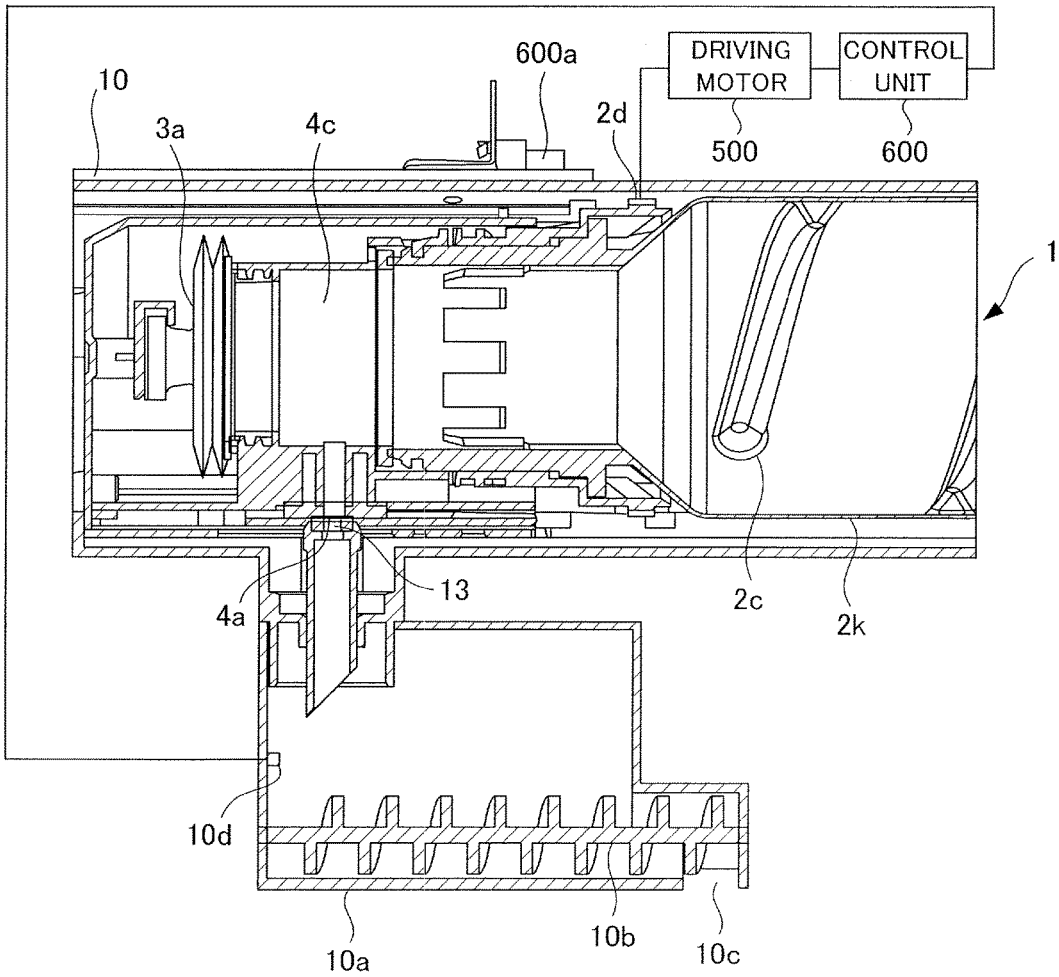
FIG. 3 is an enlarged cross-sectional view of a developer supplying container and the developer supplying device.
Figure 4:
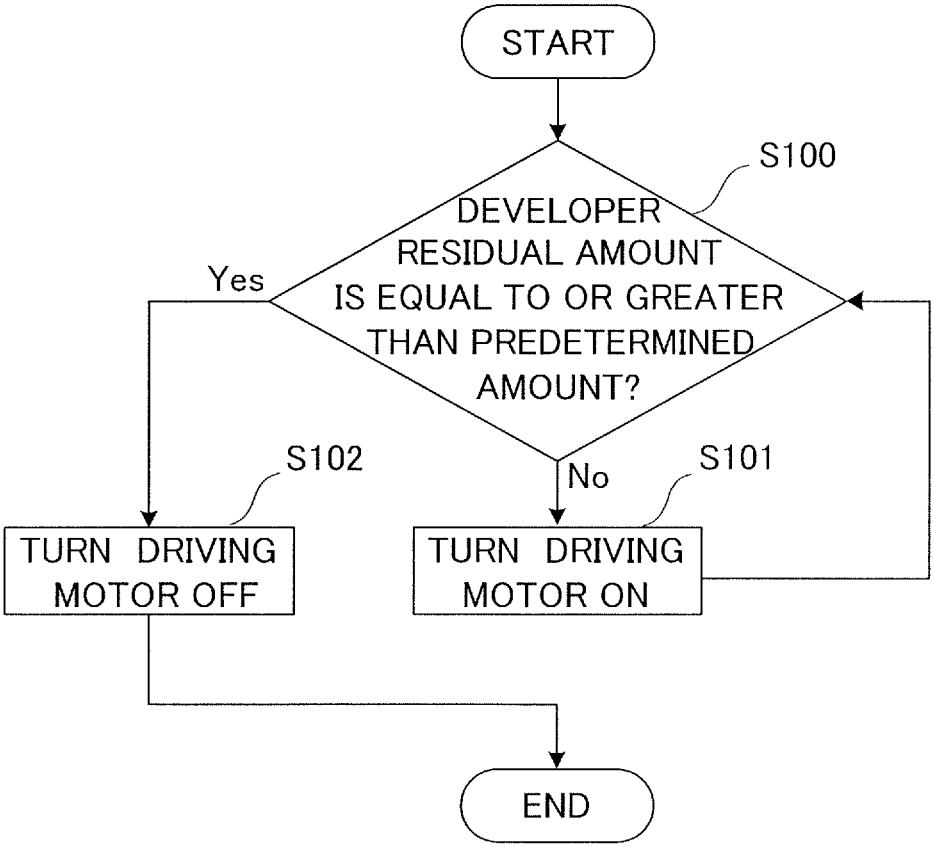
FIG. 4 is a flowchart illustrating a flow of how developer is supplied.

Next, a developer supplying device 201 as a component of a developer supplying system will be described with reference to FIGS. 1 through 4. FIG. 2A is a partial cross-sectional view of the developer supplying device 201, FIG. 2B is an outer perspective view of amounting unit 10 capable of having the developer supplying container 1 inserted thereto and removed therefrom, and FIG. 2C is a cross-sectional view of the mounting unit 10. Further, FIG. 3 is a view of a control system and a partially enlarged cross-sectional view of the developer supplying container 1 and developer supplying device 201. FIG. 4 is a flowchart illustrating a flow of supply of the developer by the control system.

As illustrated in FIG. 1, the developer supplying device 201 includes a mounting unit 10, i.e., mounting space, capable of having the developer supplying container 1 inserted thereto and removed therefrom, a hopper 10*a* temporarily storing a developer discharged from the developer supplying container 1, and the developing unit 201*a*. As illustrated in FIG. 2C, the developer supplying container 1 adopts a configuration where it is inserted to the mounting unit 10 in a direction of arrow M in the drawing. A longitudinal direction, i.e., rotation axis direction, of the developer supplying container 1, approximately corresponds to the direction of insertion. A detaching direction of the developer supplying container 1 from the mounting unit 10 is an opposite direction from the direction of arrow M in the drawing.

As illustrated in FIGS. 1 and 2A, the developing unit 201*a* includes a developing roller 201*f*, a stirring member 201*c*, and feeding members 201*d* and 201*e*. The developer supplied from the developer supplying container 1 is stirred by the stirring member 201*c*, sent via the feeding members 201*d* and 201*e* to the developing roller 201*f*, and supplied via the developing roller 201*f* to the photoreceptor 104.

Further, a leak prevention sheet 201*h* arranged to contact the developing roller 201*f* is provided to the developing roller 201*f* to prevent leakage of the developer from between a developer blade 201*g* regulating an amount of developer being coated on the roller and the developing unit 201*a*.

As illustrated in FIG. 2B, a rotational direction regulating unit 11, i.e., retention mechanism, is provided in the mounting unit 10, to regulate the flange portion 4 from moving in the rotating direction by having the regulating unit 11 abut against a flange portion 4 (refer to FIG. 6A described later) of the developer supplying container 1 in a state where the developer supplying container 1 is attached.

The mounting unit 10 has a developer reception port 13, i.e., developer reception hole, receiving the developer discharged from the developer supplying container 1 by communicating with an outlet port 4*a*, i.e., discharge hole, of the developer supplying container 1 in a state where the developer supplying container 1 is attached, as shown in FIG. 3. The developer is supplied from the outlet port 4*a* of the developer supplying container 1 via the developer reception port 13 to the hopper 10*a*. The hopper 10*a* has a conveyance screw 10*b* conveying the developer to the developing unit 201*a*, an opening 10*c* communicated with the developing unit 201*a*, and a developer sensor 10*d* detecting the amount of developer stored in the hopper 10*a*. The developer discharged from the developer supplying container 1 is supplied via the hopper 10*a* to the developing unit 201*a*.

In the present embodiment, a diameter ø of the developer reception port 13 is set to approximately 2 mm as a micro opening, i.e., pinhole, with the aim to prevent contamination of the mounting unit 10 by the developer as much as possible. The diameter of the developer reception port 13 should be set to a diameter enabling the developer to be discharged from the outlet port 4*a*.

As illustrated in FIGS. 2B and 2C, the mounting unit 10 has a driving gear 300 functioning as a driving mechanism, i.e., driving unit. A rotary driving force is transmitted to the driving gear 300 from a driving motor 500 (refer to FIG. 3) via a driving gear train, and the driving gear 300 has a function to provide a rotary driving force to the developer supplying container 1 in a state being set to the mounting unit 10.

As illustrated in FIG. 3, the operation of the driving motor 500 is controlled by a control unit 600, i.e., CPU. The control unit 600 controls the operation of the driving motor 500 based on a developer residual quantity information entered from the developer sensor 10*d*.

In the present embodiment, the driving gear 300 is designed to rotate in one direction only, so as to simplify the control of the driving motor 500. That is, the control unit 600 is configured to control only the on (operation)/off (non-operation) of the driving motor 500. Therefore, the driving mechanism of the developer supplying device 201 can be simplified compared to an arrangement of providing a reverse-rotation driving force to the developer supplying container 1 obtained by periodically rotating the driving motor 500 and the driving gear 300, in a normal direction and an opposite direction.

Attachment and Detachment of Developer Supplying Container

Next, the method of attaching and detaching the developer supplying container 1 will be described. At first, the operator opens a replacement cover (not shown) provided on the mounting unit 10, and inserts the developer supplying container 1 to the mounting unit 10. When an operator inserts the developer supplying container 1 to the depth of the mounting unit 10, the attaching of the developer supplying container 1 to the developer supplying device 201 is completed. Thereafter, the operator closes the replacement cover. Now, in a state where the developer supplying container 1 is attached, the flange portion 4 of the developer supplying container 1 is retained by and fixed to the mounting unit 10.

In a case where the developer within the developer supplying container 1 becomes empty, the operator opens the replacement cover, and detaches, i.e., removes, the developer supplying container 1 from the mounting unit 10. Then, after inserting and mounting a different developer supplying container 1 filled with a developer to the mounting unit 10, the replacement cover is closed. The operator performs the replacement operation of the developer supplying container 1 in this manner.

Developer Supplying Control by Developer Supplying Device

Next, a developer supplying control by the developer supplying device 201 will be described based on a flowchart of FIG. 4. This developer supplying control is executed by the control unit 600, i.e., CPU, controlling various equipment. According to the present embodiment, the control unit 600 performs control of operation/non-operation of the driving motor 500 according to the output of the developer sensor 10*d*, so that an amount of developer stored in the hopper 10*a* will not exceed a fixed amount.

Specifically, at first, the developer sensor 10*d* checks a developer storage amount within the hopper 10*a* (S100). If it is determined that the developer storage amount detected by the developer sensor 10*d* is smaller than a predetermined amount, that is, if a developer has not been detected by the developer sensor 10*d*, the driving motor 500 is driven, and a supplying operation of the developer is executed for a certain period of time (S101).

As a result of this developer supplying operation, if it is determined that the developer storage amount detected by the developer sensor 10*d* has reached a predetermined amount, that is, if the developer is detected by the developer sensor 10*d*, the driving of the driving motor 500 is turned off, and the supplying operation of the developer is stopped (S102). This sequence of developer supplying process is ended by stopping the supplying operation.

Such a developer supplying process is executed repeatedly when the developer is consumed by the image forming process and the developer storage amount within the hopper 10*a* becomes smaller than a predetermined value.

Figure 5:
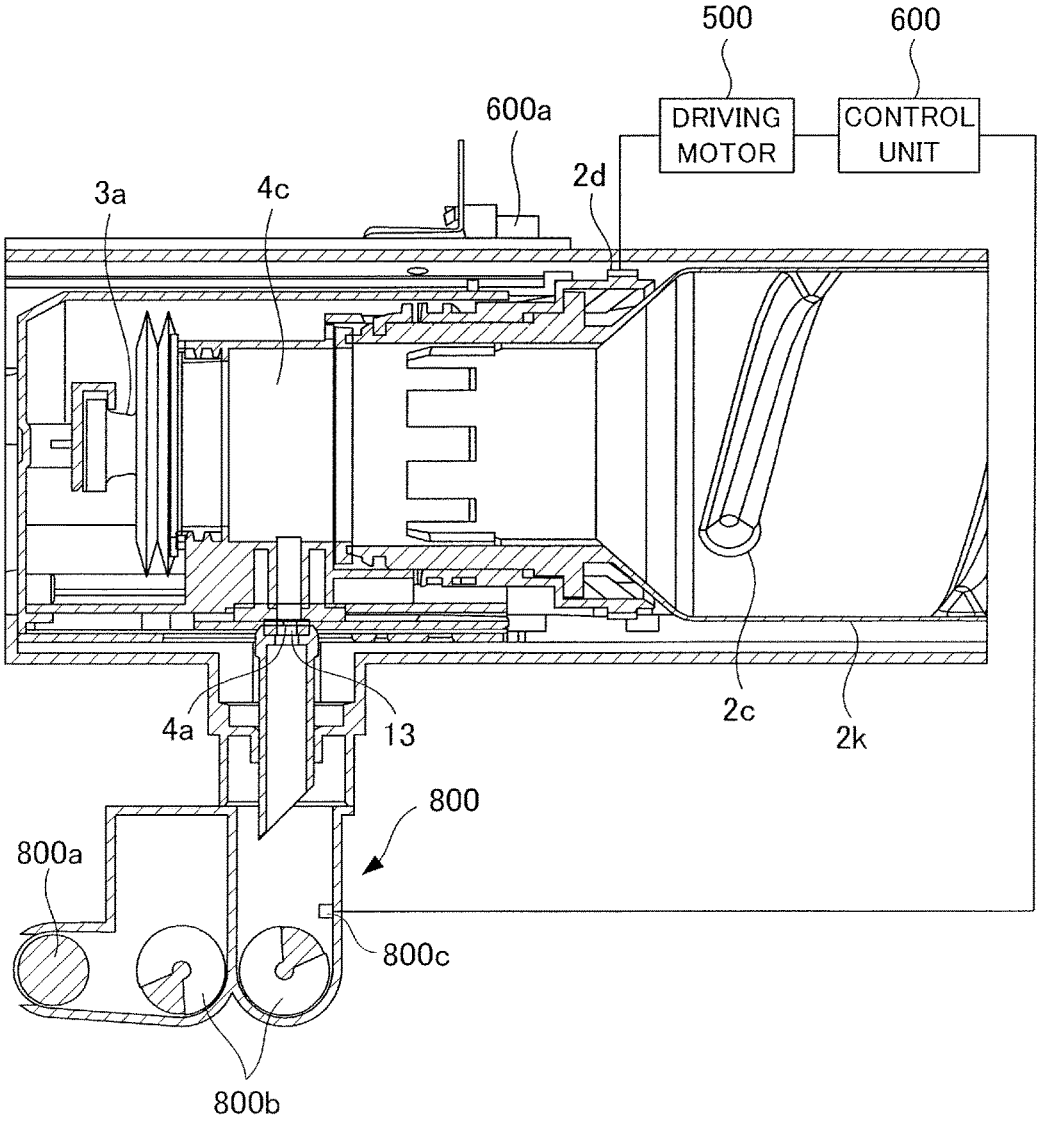
FIG. 5 is an enlarged cross-sectional view illustrating another embodiment of the developer supplying device.

The developer supplying device 201 is not restricted to the device described above, which temporarily stores the developer discharged from the developer supplying container 1 within the hopper 10*a*, and then supplies the toner to the developing unit 201*a*. For example, it can be a developer supplying device as illustrated in FIG. 5. FIG. 5 is an enlarged cross-sectional view showing another embodiment of the developer supplying device.

The developer supplying device illustrated in FIG. 5 omits the hopper 10*a* from the developer supplying device illustrated in FIG. 3, and directly supplies the developer from the developer supplying container 1 to the developing unit 800. The developing unit 800 in this case is a type of developing unit forming an image using a two-component developer containing a nonmagnetic toner and a magnetic carrier. The developing unit 800 has a stirring chamber to which the developer is supplied, and a developing chamber supplying the developer to a developing sleeve 800*a*, wherein stirring screws 800*b* are provided respectively to the stirring chamber and the developing chamber, such that the developer is conveyed in mutually opposite directions. Since the stirring chamber and the developing chamber are mutually communicated at both ends in a longitudinal direction, that is, in a developer conveyance direction, the developer is conveyed in a circulating manner in the two chambers. A magnetic sensor 800*c* detecting a toner concentration of the developer is disposed within the stirring chamber, and the operation of the driving motor 500 is controlled by the control unit 600 based on the result of detection of the magnetic sensor 800*c*.

Developer Supplying Container

Figure 6A:
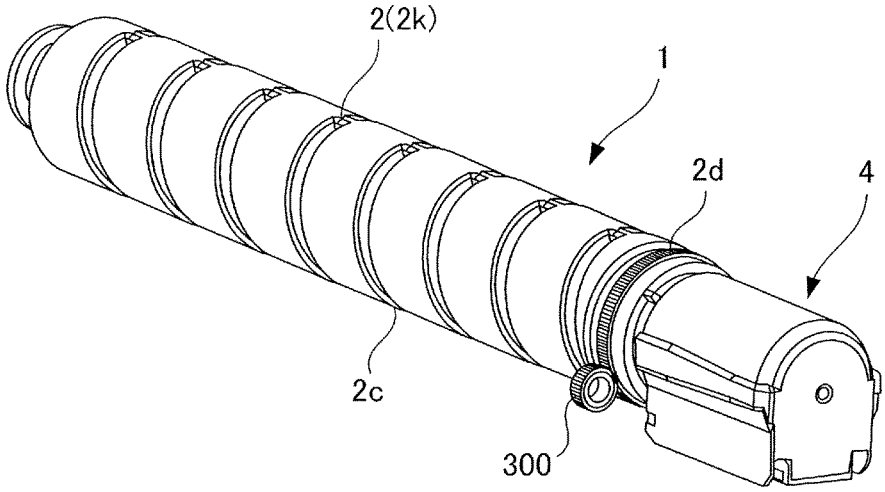
FIG. 6A is an outer perspective view of a developer supplying container.
Figure 6B:
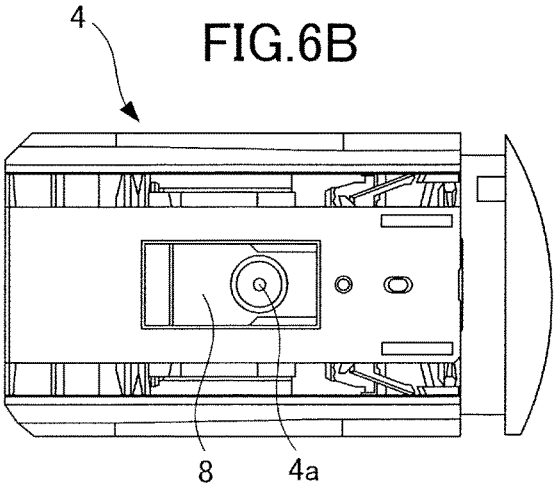
FIG. 6B is a partial enlarged view illustrating a circumference of an outlet port.
Figure 6C:
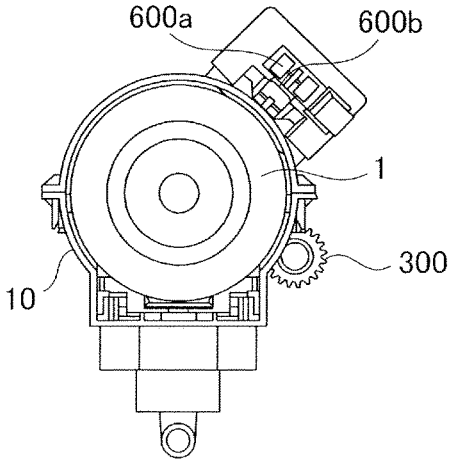
FIG. 6C is a front view illustrating a state where the developer supplying container is mounted to a mounting unit of the developer supplying device.
Figure 7A:
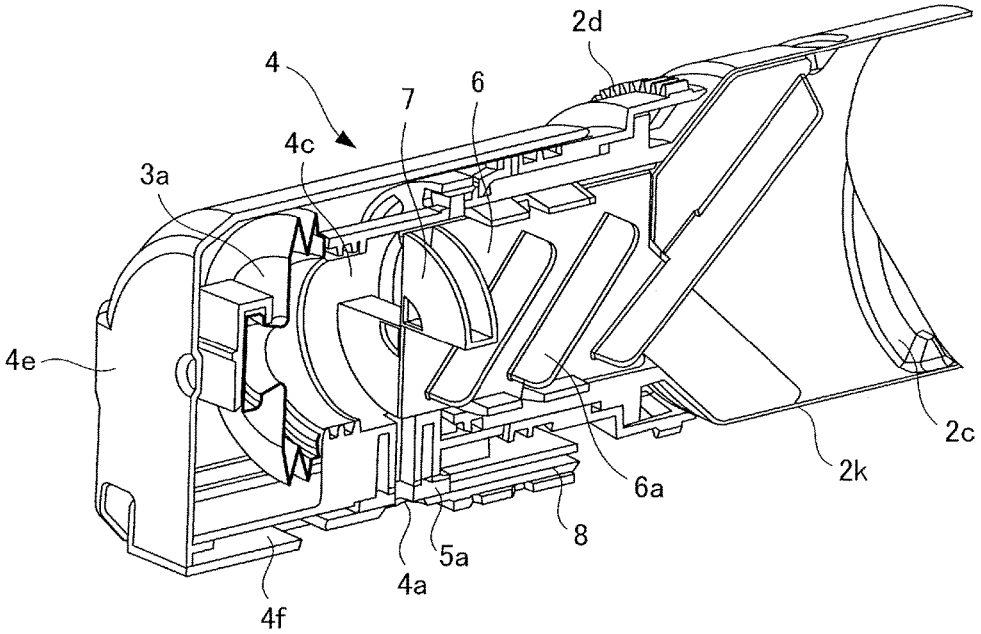
FIG. 7A is a perspective cross-sectional view of the developer supplying container.

Next, the developer supplying container 1 will be described with reference to FIGS. 6A through 7C. FIG. 6A is an outer perspective view of the developer supplying container 1, FIG. 6B is a partial enlarged view of the area around the outlet port 4*a* of the developer supplying container 1, and FIG. 6C is a front view showing a state where the developer supplying container 1 is attached to the mounting unit 10. Further, FIG. 7A is a cross-sectional perspective view of the developer supplying container, FIG. 7B is a partial cross-sectional view of a state where a pump portion is expanded to a maximum state during use, and FIG. 7C is a partial cross-sectional view of a state where the pump portion is contracted to a minimum state during use.

The developer supplying container 1, i.e., developer storage container, includes a developer storage portion 2, also referred to as a container body, formed in a hollow cylindrical shape and having an internal space storing a developer, as illustrated in FIG. 6A. In the present embodiment, a cylindrical portion 2*k*, a discharge portion 4*c* (refer to FIG. 5) and a pump portion 3*a* (refer to FIG. 5) function as the developer storage portion 2. Further, the developer supplying container 1 has a flange portion 4, also referred to as a non-rotating portion, on one end in a longitudinal direction, i.e., a developer conveyance direction, of the developer storage portion 2. Further, the cylindrical portion 2*k* is designed to be relatively rotatable with respect to the flange portion 4. The cross-sectional shape of the cylindrical portion 2*k* can be non-circular, as long as the shape is within a range not affecting the rotational movement during the developer supplying process. For example, an oval shape or a polygonal shape can also be adopted.

Figure 7B:
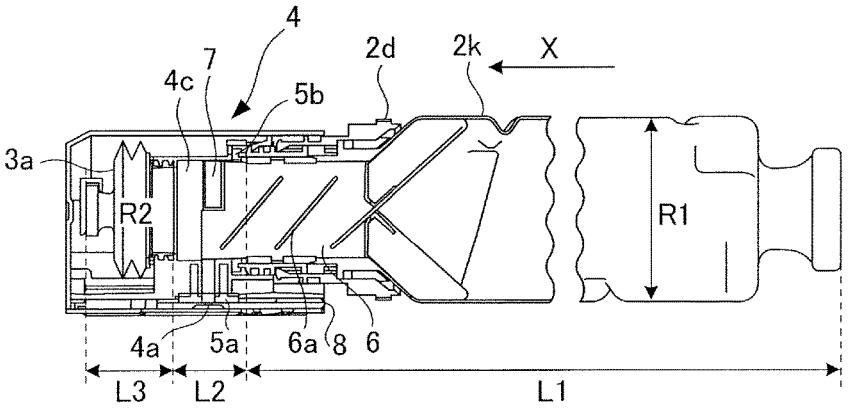
FIG. 7B is a partial cross-sectional view of a state where a pump portion is expanded to a maximum state during use.
Figure 7C:
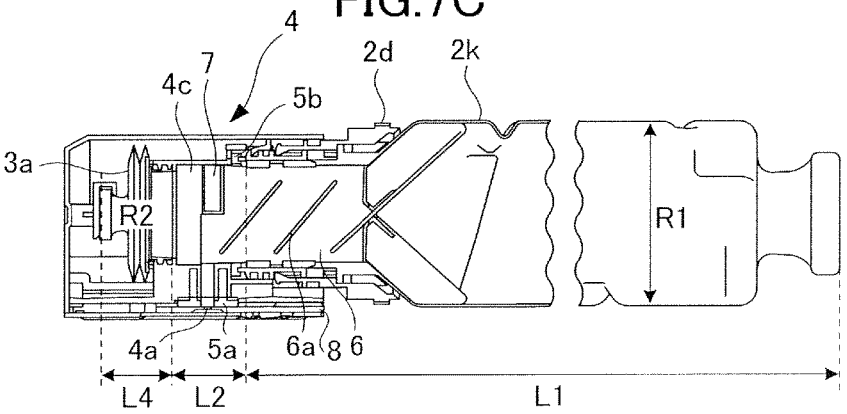
FIG. 7C is a partial cross-sectional view of a state where the pump portion is contracted to a minimum state during use.

In the present embodiment, a total length L1 of the cylindrical portion 2*k* functioning as a developer storage chamber is set to approximately 460 mm, and an outer diameter R1 is set to approximately 60 mm, as shown in FIG. 7B. Further, a length L2 of an area in which the discharge portion 4*c* functioning as a developer discharge chamber is provided is approximately 21 mm. The total length L3 of the pump portion 3*a*, in a state where the pump portion is expanded to a maximum length within the possible expandable and contractible range during use, is approximately 29 mm, and as shown in FIG. 7C, a total length L4 of the pump portion 3*a*, in a state where the pump portion is contracted to a minimum length within the possible expandable and contractible range during use, is approximately 24 mm.

Material of Developer Supplying Container

As described later, according to the present embodiment, the developer is discharged through the outlet port 4*a* by changing the capacity within the developer supplying container 1 by the pump portion 3*a*. Therefore, it is preferable to adopt a material having a certain stiffness for the developer supplying container so that the developer supplying container 1 will not be crashed greatly or expanded significantly with respect to the change of capacity.

According further to the present embodiment, the developer supplying container 1 adopts a configuration where the container is only communicated via the outlet port 4*a* with the exterior during discharge of the developer, and that the container is airtight from the exterior except for the outlet port 4*a*. In other words, an airtightness of a level capable of maintaining a stable discharge performance is required, since the developer supplying container 1 adopts a configuration where the developer is discharged through the outlet port 4*a* by reducing or increasing the capacity of the developer supplying container 1 by the pump portion 3*a*.

Therefore, according to the present embodiment, polystyrene resin is used as the material of the developer storage portion 2 and the discharge portion 4*c*, and polypropylene resin is used as the material of the pump portion 3*a*.

As for the material being used, other resin material such as ABS (acrylonitrile-butadiene-styrene copolymer), polyester, polyethylene or polypropylene can also be used for the developer storage portion 2 and the discharge portion 4*c*, as long as they can endure the change of capacity. Further, they can be formed of metal.

As for the material of the pump portion 3*a*, it can be any material as long as it exerts an elastic function and changes the capacity of the pump portion so as to change the capacity of the developer supplying container 1. For example, the pump portion can be formed of ABS (acrylonitrile-butadiene-styrene copolymer), polystyrene, polyester, polyethylene and the like formed into a thin sheet. Further, rubber or other elastic material can also be used.

If the pump portion 3*a*, the developer storage portion 2 and the discharge portion 4*c* can respectively satisfy the above-described functions, such as by adjusting the thickness of the resin material, for example, they can all be formed integrally using the same material, such as by an injection molding process or a blow molding process.

Hereafter, the configurations of the flange portion 4, the cylindrical portion 2*k*, the pump portion 3*a*, a drive receive mechanism, i.e., gear portion 2*d*, and a drive conversion mechanism, i.e., cam groove 2*e*, in the developer supplying container 1 will be described in detail.

Flange Portion

As illustrated in FIGS. 7A and 7B, a hollow discharge portion, i.e., developer discharge chamber, 4*c* temporarily storing the developer conveyed from the cylindrical portion 2*k* is provided in the flange portion 4. The outlet port 4*a* as an opening portion is formed on a bottom surface of the discharge portion 4*c*. An opening seal 5*a* with a hole is provided in the circumference of the outlet port 4*a*. The opening seal 5*a* as a sealing member is adhered by double sided tape to the discharge portion 4*c*, and prevents the developer from leaking from the space around the outlet port 4*a* by being abutted against the shutter 8 and the discharge portion 4*c* and sealing the gap formed between the components, as described later. The shutter 8 will be described in detail later.

Further, the flange portion 4 is configured to be approximately immobile when the developer supplying container 1 is attached to the mounting unit 10. Specifically, the flange portion 4 is provided with a rotational direction regulating unit 11 as illustrated in FIG. 2B, preventing the flange portion 4 from rotating in the rotational direction of the cylindrical portion 2*k*. Therefore, in a state where the developer supplying container 1 is mounted on the mounting unit 10, the discharge portion 4*c* provided on the flange portion 4 is also approximately immobile to the rotational direction of the cylindrical portion 2*k* (a slight movement such as a backlash is permitted). When mounting the developer supplying container 1, the container is inserted to the mounting unit 10 with the side having the flange portion 4 positioned at a leading end.

On the other hand, the cylindrical portion 2*k* is capable of rotating during the developer supplying process, without being regulated by the developer supplying device 201 from rotating in the rotational direction.

Further, as shown in FIGS. 7A through 7C, a plate-like conveyance member 6 for conveying the developer conveyed from the cylindrical portion 2*k* via a spiral convex portion, i.e., conveyance projection 2*c*, to the discharge portion 4*c* is provided. The conveyance member 6 is provided to divide a portion of the developer storage portion 2 approximately into two parts, and is designed to rotate integrally with the cylindrical portion 2*k*. A plurality of inclined ribs 6*a* inclined toward the discharge portion 4*c* with respect to the rotation axis direction of the cylindrical portion 2*k* is provided on both surfaces of the conveyance member 6.

According to the configuration described above, the developer conveyed from the conveyance projection 2*c* is scraped up from a lower area upward in a vertical direction by the plate-like conveyance member 6 in conjunction with the rotation of the cylindrical portion 2*k*. Thereafter, as the rotation of the cylindrical portion 2*k* progresses, the developer slides down on the surface of the conveyance member 6 by gravity, and the developer is handed over to the discharge portion 4*c* side by the inclined ribs 6*a*. According to the present arrangement, the inclined ribs 6*a* are provided on both surfaces of the conveyance member 6 such that the developer is conveyed to the discharge portion 4*c* every semi-rotation of the cylindrical portion 2*k*.

Cylindrical Portion

Next, the cylindrical portion 2*k* functioning as a developer storage chamber will be described with reference to FIGS. 6A through 7C.

The conveyance projection 2*c* projected spirally and functioning to convey the stored developer by its own rotation toward the discharge portion 4*c*, i.e., the outlet port 4*a*, functioning as the developer discharge chamber is formed on the inner side of the cylindrical portion 2*k*, as illustrated in FIGS. 6A through 7C. The cylindrical portion 2*k* is formed via a blow molding method using the resin material described earlier.

Further, the cylindrical portion 2*k* is fixed relatively rotatably with respect to the flange portion 4 in a state compressing a flange seal 5*b* of a ring-like seal member disposed on an inner side of the flange portion 4, as illustrated in FIGS. 7B and 7C.

Thereby, the cylindrical portion 2*k* rotates while sliding against the flange seal 5*b*, so that the developer will not leak during rotation, and airtightness is maintained. In other words, the air is appropriately taken in and discharged through the outlet port 4*a*, and the change of capacity of the developer supplying container 1 while the developer is being supplied can be set to a desired state.

Pump Portion

The pump portion 3*a* illustrated in FIGS. 7A through 7C operates such that an internal pressure of the developer storage portion 2 is repeatedly switched between a state lower than atmospheric pressure and a state higher than atmospheric pressure, by the driving force received by the gear portion 2*d*.

According to the present embodiment, as mentioned earlier, the pump portion 3*a* is provided to a portion of the developer supplying container 1, so as to have the developer stably discharged through the small outlet port 4*a*. The pump portion 3*a* is a capacity variable pump formed of resin and having a variable capacity. Specifically, a member configured of a bellows-type elastic member capable of expanding and contracting is adopted as the pump portion 3*a*. More specifically, a bellows-type pump is adopted such that a plurality of "mountain-fold" portions and "valley-fold" portions are cyclically and alternately formed, as illustrated in FIGS. 7A through 7C.

Through an expansion and contraction operation of the pump portion 3*a*, the pressure within the developer supplying container 1 is changed, and the developer is discharged by the pressure. Specifically, when contracting the pump portion 3*a*, the interior of the developer supplying container 1 is set to a pressurized state, and the developer is discharged from the outlet port 4*a* by being pushed out by the pressure. When expanding the pump portion 3*a*, the interior of the developer supplying container 1 is set to a decompressed state, and air is taken in from the exterior through the outlet port 4*a*. The developer near the outlet port 4*a* is loosened by the air being taken in, and the subsequent discharge is performed smoothly. The developer is discharged by the pump portion 3*a* repeating the above-described expansion and contraction operation. When a bellows-type pump portion 3*a* as according to the present embodiment is adopted, the dispersion of the amount of capacity change with respect to the amount of expansion and contraction can be reduced, so that a stable capacity variation operation can be performed.

Drive Receive Mechanism

Next, we will describe a drive receive mechanism, i.e., drive input portion or driving force receive portion, of the developer supplying container 1 that receives a rotary driving force rotating the cylindrical portion 2*k* having the conveyance projection 2*c* from the developer supplying device 201.

The gear portion 2*d* capable of engaging with, i.e., drive coupled to, the driving gear 300 of the developer supplying device 201 is provided to the developer supplying container 1, as illustrated in FIG. 6A. The driving gear 300 functions as a driving mechanism of the developer supplying device 201. The gear portion 2*d* functions as a drive receive mechanism, i.e., drive input portion or driving force receive portion. The gear portion 2*d* is configured to be able to rotate integrally with the cylindrical portion 2*k*. Therefore, the rotary driving force entered from the driving gear 300 to the gear portion 2*d* is designed to be transmitted via a reciprocating member 3*b* of FIGS. 8A and 8*b* to the pump portion 3*a*. Specifically, the configuration will be described with respect to the drive conversion mechanism. The bellows-shaped pump portion 3*a* according to the present embodiment is manufactured using a resin material having a property strong against torsion in the rotating direction within a range not interfering with the expansion and contraction operation.

In the present embodiment, the gear portion 2*d* is provided at a leading end side in a developer conveyance direction of the cylindrical portion 2*k*, but the present embodiment is not restricted to this example, and the gear portion can be provided at the other end side in the longitudinal direction of the developer storage portion 2, that is, at the rear end side, for example. In that case, the driving gear 300 is provided at a corresponding position.

In the present embodiment, a gear mechanism is provided as a drive connection mechanism between the drive input portion of the developer supplying container 1 and the driving unit of the developer supplying device 201, but the present embodiment is not restricted to this example, and a known coupling mechanism can also be used, for example. Specifically, it is possible to provide a noncircular concave portion as the drive input portion, and on the other hand, provide a convex portion having a shape corresponding to the aforementioned concave portion as the driving unit of the developer supplying device 201, which are mutually drive-connected.

Drive Conversion Mechanism

Next, a drive conversion mechanism, i.e., drive conversion unit, of the developer supplying container 1 will be described. In the present embodiment, a case where a cam mechanism is utilized as the drive conversion mechanism will be described.

A cam mechanism functioning as a drive conversion mechanism, i.e., drive conversion unit, converting the rotary driving force received by the gear portion 2*d* rotating the cylindrical portion 2*k* to a force in a direction reciprocating the pump portion 3*a* is provided to the developer supplying container 1. In other words, according to the present embodiment, the rotary driving force received by the gear portion 2*d* is converted into reciprocating force at the developer supplying container 1 side, so as to receive the driving force rotating the cylindrical portion 2*k* and the driving force reciprocating the pump portion 3*a* by one drive input portion, i.e., the gear portion 2*d*. Thereby, the configuration of the drive input mechanism of the developer supplying container 1 can be simplified, compared to a case where two separate drive input portions are provided in the developer supplying container 1. Moreover, since drive is received from one driving gear of the developer supplying device 201, the configuration also contributes to simplifying the driving mechanism of the developer supplying device 201.

Figure 8A:
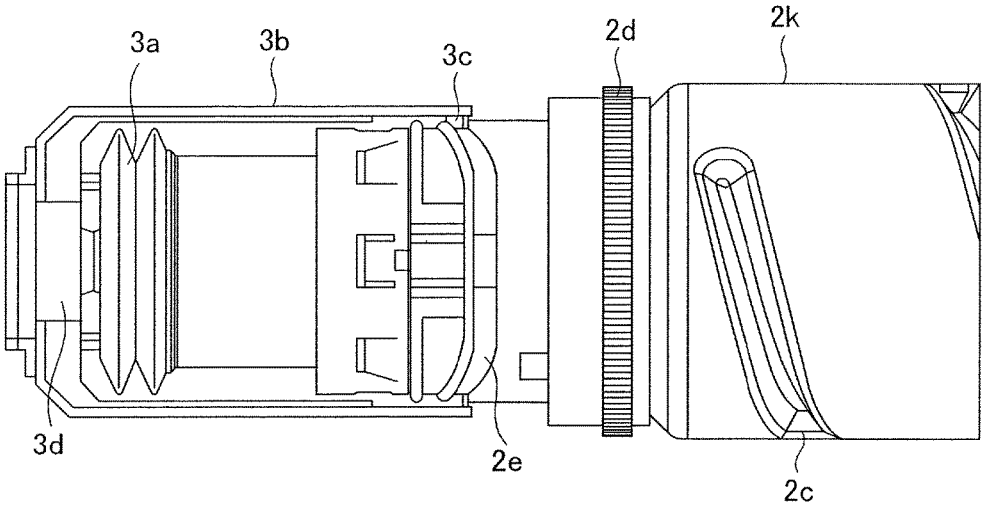
FIG. 8A is a partial view of a state where the pump portion is expanded to the maximum state during use.
Figure 8B:
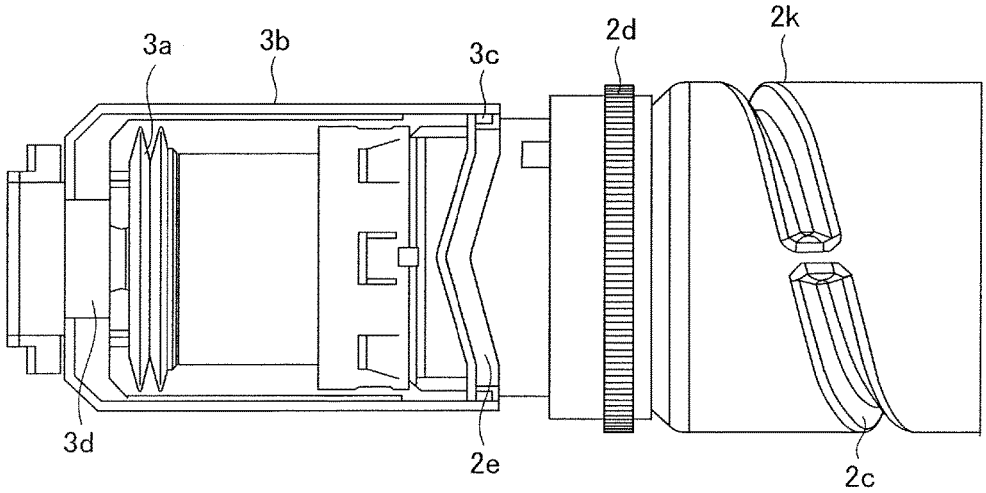
FIG. 8B is a partial view of a state where the pump is contracted to a minimum state during use.
Figure 8C:
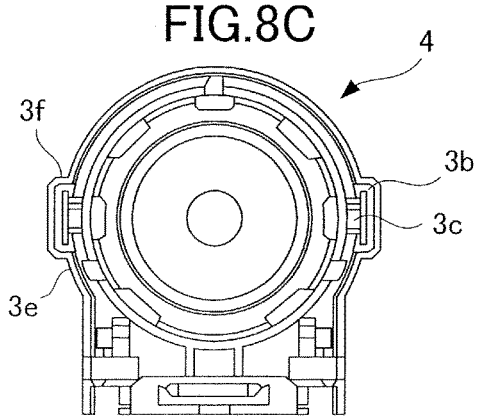
FIG. 8C is a partial view of the pump portion.

FIG. 8A is a partial view of the pump portion 3*a* in the most expanded state in the state of use, FIG. 8B is a partial view of the pump portion 3*a* in the most contracted state in the state of use, and FIG. 8C is a partial view of the pump portion. As shown in FIGS. 8A and 8B, the reciprocating member 3*b* is used as an intervened member converting the rotary driving force to the reciprocating force of the pump portion 3*a*. Specifically, the drive input portion, i.e., gear portion 2*d*, having received the rotary drive from the driving gear 300 and a cam groove 2*e* formed integrally with the gear portion 2*d* and having grooves formed to a whole circumference thereof are rotated. A reciprocating member engagement projection 3*c* having a portion projected from the reciprocating member 3*b* is engaged with the cam groove 2*e*. In the present embodiment, the rotational direction of the cylindrical portion 2*k* of the reciprocating member 3*b* is regulated by a protection member rotation regulating portion 3*f* such that the reciprocating member 3*b* itself does not rotate in the rotational direction of the cylindrical portion 2*k*, as illustrated in FIG. 8C (a slight movement such as a backlash is permitted). As described, the reciprocating member 3*b* is regulated to reciprocate along the groove of the cam groove 2*e*, that is, in a direction of arrow X and the opposite direction thereof in FIG. 7, by having the rotational direction regulated. Further, a plurality of reciprocating member engagement projections 3*c* are provided to engage with the cam groove 2*e*. Specifically, two reciprocating member engagement projections 3*c* are provided to oppose to one another at approximately 180 degrees on an outer circumference surface of the cylindrical portion 2*k*.

At least one reciprocating member engagement projection 3*c* should be provided. However, a moment occurs to the drive conversion mechanism and the like by a drag during expansion and contraction of the pump portion 3*a*, which may possibly prevent smooth reciprocation. Therefore, a plurality of reciprocating member engagement projections 3*c* should be provided to prevent deterioration of the relationship between the shapes of the cam groove 2*e* described later.

As described, the reciprocating member engagement projection 3*c* is reciprocated in the arrow X direction or the opposite direction along the cam groove 2*e*, by having the cam groove 2*e* rotate by the rotary drive force entered from the driving gear 300. In response, the pump portion 3*a* in the expanded state (FIG. 8A) and the pump portion 3*a* in the contracted state (FIG. 8B) are alternately repeated to realize capacity variation of the developer supplying container 1.

Shutter

As illustrated in FIG. 7A, the developer supplying container 1 is configured such that a shutter 8 can be mounted on a bottom portion of the discharge portion 4*c* to nip the opening seal 5*a* with the discharge portion 4*c*. The shutter 8 closes the outlet port 4*a* in a state where the developer supplying container 1 is not attached to the developer supplying device 201, and opens the outlet port 4*a* in a state where the developer supplying container 1 is attached to the developer supplying device 201. That is, the shutter 8 can open and close the outlet port 4*a* along with the inserting and removing operation of the developer supplying container 1 to and from the developer supplying device 201. Thereby, prevention of leaking of the developer from the developer supplying container 1 in the non-attached state and the supplying of the developer from the developer supplying container 1 in the attached state can be realized. The shutter 8 according to the present embodiment will be described with respect to FIGS. 9A through 10.

Figure 9A:
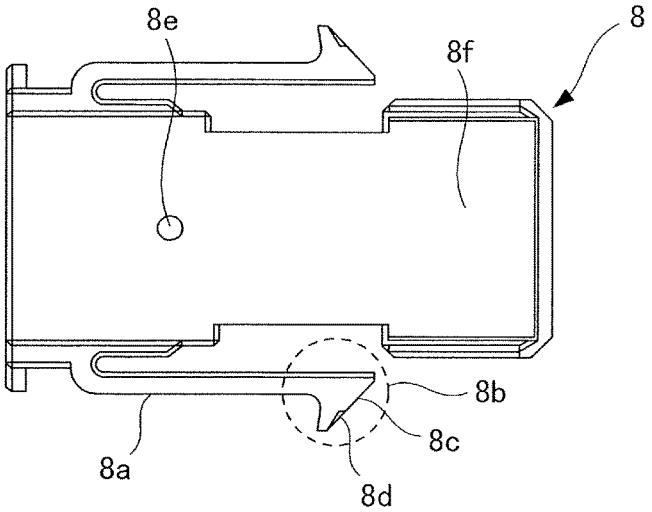
FIG. 9A is an upper view of a shutter according to the embodiment.
Figure 9B:
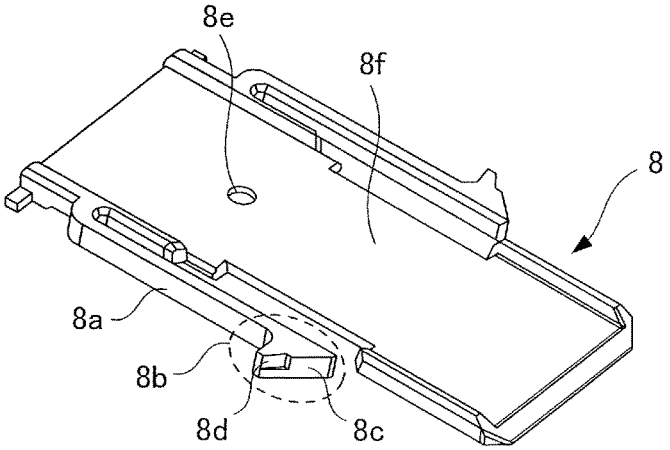
FIG. 9B is an outer perspective view of the shutter according to the embodiment.

As illustrated in FIGS. 9A and 9B, the shutter 8 has a plate-like shielding portion 8*f* as a body unit, and a shutter opening 8*e* is opened on the shielding portion 8*f*. The shutter 8 is attached slidably to the outlet port 4*a* of the developer supplying container 1. Therefore, the developer is discharged from the developer supplying container 1 only when the shutter opening 8*e* of the shielding portion 8*f* is opposed to the outlet port 4*a*, and in other cases, the developer is not discharged from the developer supplying container 1.

The shutter 8 has two lock portions 8*a* extending from side surfaces of the shielding portion 8*f* in an inserting direction of the shutter 8 (referred to as an attachment direction, for convenience) with respect to the developer supplying container 1. The lock portions 8*a* are designed to deform elastically, and a lock claw portion 8*b* surrounded by a dotted line in the drawing is provided to a tip portion of each lock portion 8*a*. The lock portions 8*a* elastically deform to an inner side in a width direction toward the shielding portion 8*f* when the lock claw portion 8*b* is pressed inward in the width direction orthogonal to the attachment direction of the shutter 8. When the pressure toward the inner side in the width direction is released, elastic deformation of the lock portion 8*a* is recovered in the outer side in the width direction away from the shielding portion 8*f*. According to the elastic deformation of the lock portion 8*a*, the lock claw portion 8*b* can move in the width direction.

The lock claw portion 8*b* is formed to project toward the outer side in the width direction intersecting the attachment direction of the shutter 8. The lock claw portion 8*b* has two different inclined surfaces formed on a leading end, a second inclined surface 8*c* and a first inclined surface 8*d*. As illustrated in FIG. 9B, the first inclined surface 8*d* is formed in a concave shape, by cutting one portion on an upper end side of the second inclined surface 8*c* away from the outer end portion in the width direction of the second inclined surface 8*c* toward an end portion in an inner side in the width direction. The first inclined surface 8*d* is formed closer to a base end side (opposite from the tip side) of the lock portion 8*a* than the second inclined surface 8*c* with respect to the attachment direction of the shutter 8.

Figure 9C:
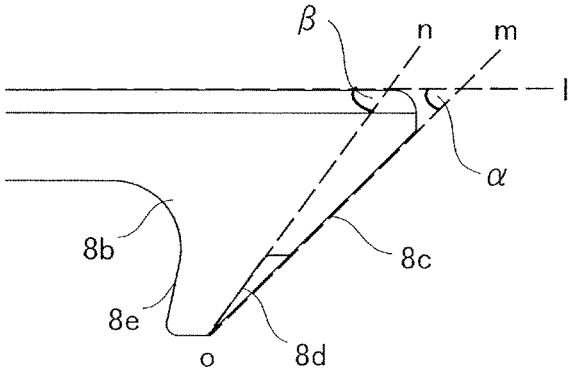
FIG. 9C is an enlarged view of a lock claw portion illustrating the shutter according to the embodiment.

As illustrated in FIG. 9C, the first inclined surface 8*d* is formed such that an inclination angle β becomes greater than an inclination angle α, i.e., predetermined angle, of the second inclined surface 8*c* (α<β). Stated another way, the inclination angle α of the second inclined surface 8*c* is smaller than the inclination angle β of the first inclined surface 8*d*. Now, the inclination angle β of the first inclined surface 8*d* is the angle formed by a straight line n extended along the first inclined surface 8*d* from a point ○ on the outer end portion in the width direction of the lock claw portion 8*b* and a straight line 1 extended in an attachment direction of the shutter 8 along the lock portion 8*a*. In contrast, the inclination angle α of the second inclined surface 8*c* is the angle formed by a straight line m extending along the second inclined surface 8*c* from the point ○ on the outer end portion in the width direction of the lock claw portion 8*b* and a straight line 1 extended in an attachment direction of the shutter 8 along the lock portion 8*a*. According further to the present embodiment, the direction of the straight line 1 does not only correspond to the attachment direction of the shutter 8, but it also approximately corresponds to the detachment direction of the developer supplying container 1, which is a direction opposite from the attachment direction.

Figure 10:
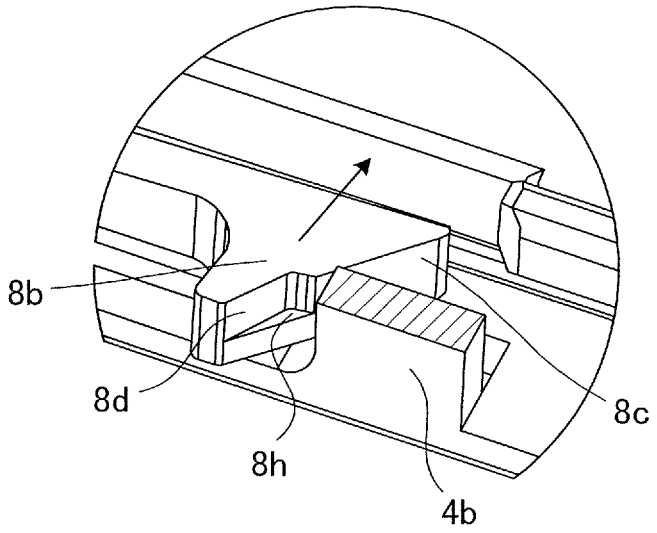
FIG. 10 is a partially enlarged perspective view illustrating an inclined surface of the lock claw portion.

As illustrated in FIG. 10, the lock claw portion 8*b* has a concave portion 8*h* formed in a concaved shape to a portion of the second inclined surface 8*c*. The concave portion 8*h* is formed orthogonal to a width direction intersecting the attachment direction of the shutter 8 and also displaced in the direction orthogonal to the attachment direction of the shutter 8. The first inclined surface 8*d* is provided on the concave portion 8*h*, and the second inclined surface 8*c* is provided to an area other than the concave portion 8*h*. Therefore, the first inclined surface 8*d* is arranged on an upstream side in the attachment direction of the shutter 8 than the second inclined surface 8*c*, in a state arranged as a portion of the second inclined surface 8*c*. As described, the lock claw portion 8*b* has two inclined surfaces 8*c* and 8*d* with different inclination angles.

Shutter Attachment

Figure 11A:
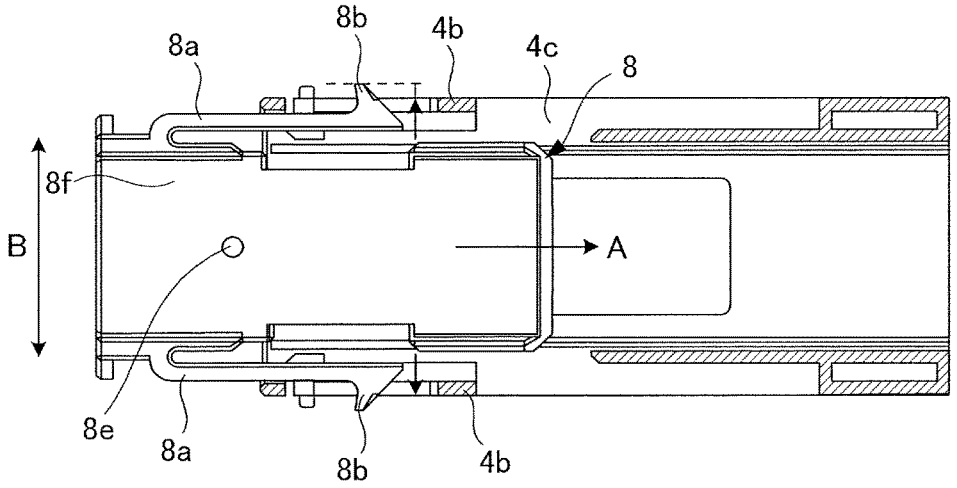
FIG. 11A is an upper view illustrating a state where the shutter is started to be attached to the developer supplying container.
Figure 11B:
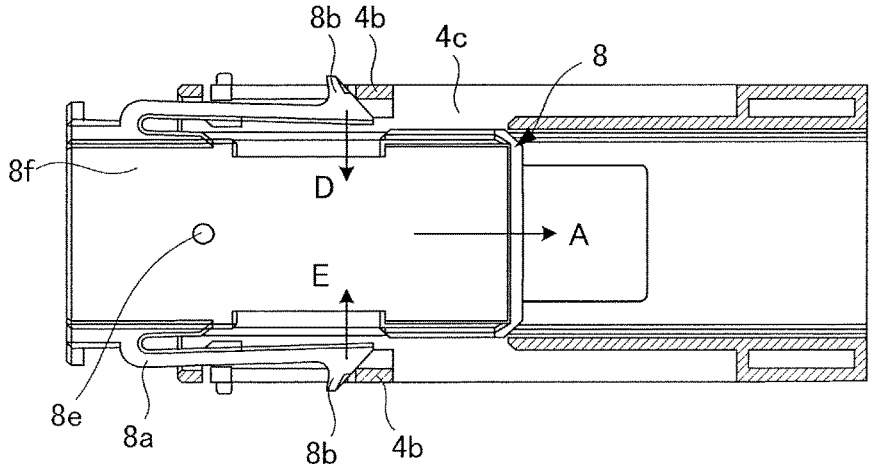
FIG. 11B is an upper view illustrating a state where the shutter is in midway of attachment to the developer supplying container.
Figure 11C:
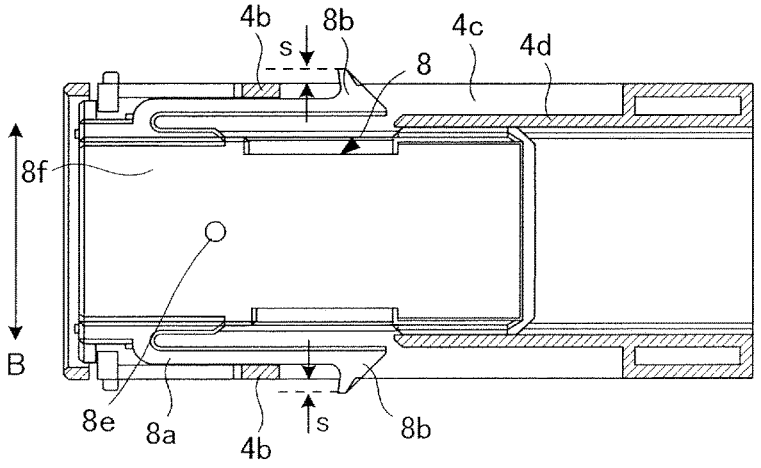
FIG. 11C is an upper view illustrating a state where the shutter is completely attached to the developer supplying container.

The mounting of the shutter 8 described above to the developer supplying container 1 will be described with reference to FIGS. 11A through 11C. FIG. 11A illustrates an attachment starting timing of the shutter 8 to the developer supplying container 1, FIG. 11B illustrates a state in midway of attachment of the shutter 8, and FIG. 11C illustrates a completion of attachment of the shutter 8.

As illustrated in FIG. 11A, the shutter 8 is attached by sliding the shutter against the developer supplying container 1 in a longitudinal direction of the developer supplying container 1. The direction of attachment of the shutter 8 in this embodiment is an arrow A direction in the drawing. When the shutter 8 is attached to the developer supplying container 1, the lock portion 8*a* of the shutter 8 enters an attachment path of the discharge portion 4*c* of the developer supplying container 1. An attachment contact portion 4*b* as a second contact portion is provided in a manner narrowing the width of an attachment path in midway of the attachment path of the discharge portion 4*c*. When the shutter 8 is inserted to the developer supplying container 1, at some point of time, the lock claw portion 8*b*, more precisely, the second inclined surface 8*c*, of the lock portion 8*a* abuts against the attachment contact portion 4*b*. When the shutter 8 is further pushed in a state where the lock claw portion 8*b* abuts against the attachment contact portion 4*b*, the lock claw portion 8*b* slides while being pressed toward an inner side in the width direction, that is, in the directions of arrows D and E in the drawing, as illustrated in FIG. 11B, the lock portion 8*a* moves while elastically deforming inward in the width direction. Along with the elastic deformation of the lock portion 8*a*, the lock claw portion 8*b* surpasses the attachment contact portion 4*b*. At the point of time when the lock claw portion 8*b* surpasses the attachment contact portion 4*b*, the pressure toward the inner side in the width direction of the lock portion 8*a* is released, and elastic deformation of the lock portion 8*a* is recovered toward the outer side in the width direction. Then, as shown in FIG. 11C, the attachment of the shutter 8 is completed by having the lock portion 8*a* inserted more deeply into position.

As described in detail later (refer to FIG. 12A described later), when the developer supplying container 1 is attached to the developer supplying device 201, the lock claw portion 8*b* of the lock portion 8*a* is engaged with the developer supplying device 201, such that the shutter opening 8*e* is opposed to the outlet port 4*a*. As illustrated in FIG. 11C, the shutter 8 is attached to the developer supplying container 1 to have the lock claw portion 8*b* protrude for a predetermined amount, shown as a projection amount s in the drawing, in the width direction from the discharge portion 4*c*.

After attaching the shutter 8 to the developer supplying container 1, a protection cover 4*e* is attached to the flange portion 4 (refer to FIG. 7A) of the developer supplying container 1. The protection cover 4*e* has an opposing portion 4*f* positioned to oppose to one end portion of the shutter 8. When the opposing portion 4*f* is abutted against one end portion of the shutter 8, the shutter opening 8*e* is not opposed to the outlet port 4*a*, and the shielding portion 8*f* is opposed to the outlet port 4*a*. A relative position of the shutter 8 in this state with respect to the developer supplying container 1 is referred to an "initial position" in this description. In a state where the developer supplying container 1 is not attached to the developer supplying device 201, the shutter 8 is positioned at the "initial position" with the outlet port 4*a* closed.

According to the present embodiment, in order to smoothly attach the shutter 8 to the developer supplying container 1, the second inclined surface 8*c* having an inclination angle α is formed on the lock claw portion 8*b*. The lock portion 8*a* is easily deflected when the lock claw portion 8*b* is abutted against the attachment contact portion 4*b* by forming the second inclined surface 8*c*, so that the lock claw portion 8*b* can surpass the attachment contact portion 4*b* without applying a large force during attachment. Accordingly, the shutter 8 can be attached smoothly. However, as the inclination angle α of the second inclined surface 8*c* (refer to FIG. 9C) increases, the sliding resistance between the second inclined surface 8*c* and the attachment contact portion 4*b* is increased, and the possibility of the lock claw portion 8*b* getting caught in the attachment contact portion 4*b* and the lock claw portion 8*b* being damaged is increased. In order to prevent this problem from occurring, it is preferable to set the inclination angle α of the second inclined surface 8*c* to be as small as possible, and weaken the sliding resistance between the second inclined surface 8*c* and the attachment contact portion 4*b*.

Other than the second inclined surface 8*c* having the inclination angle α, the first inclined surface 8*d* having the inclination angle β is formed on the lock claw portion 8*b*, but during attachment of the shutter 8, it is necessary to have the second inclined surface 8*c* with a small inclination angle α capable of reducing the sliding resistance abut against the attachment contact portion 4*b*. In order to realize this state, as already described, the second inclined surface 8*c* is formed on the whole surface of the lock claw portion 8*b*, while the first inclined surface 8*d* is formed in a concaved state from the second inclined surface 8*c*, recessed in the attachment direction.

Attachment of the Developer Supplying Container

Next, the mounting operation of the developer supplying container 1 to which the shutter 8 is attached to the developer supplying device 201 will be described with reference to FIGS. 12A through 14B. A mounting operation refers to an operation where a not-yet-mounted developer supplying container 1 is mounted to the mounting unit 10, and feeding of the developer is enabled by the developer supplying device 201. In FIGS. 12A through 14B, the left side in the drawing is the flange portion 4 side, and the right side in the drawing is the developer storage portion 2 side.

Figure 12A:
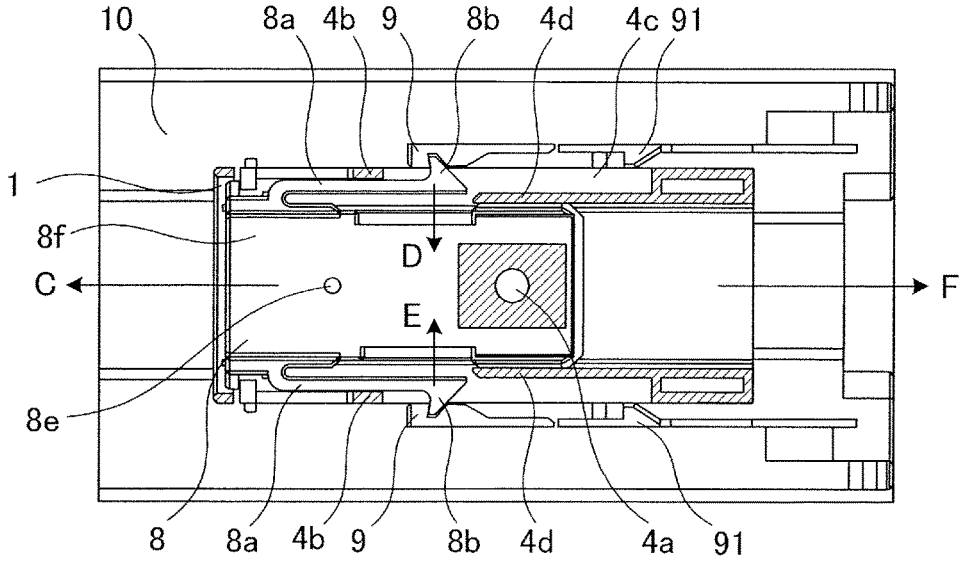
FIG. 12A is an upper view illustrating a state where the developer supplying container is started to be mounted to the developer supplying device.

The developer supplying container 1 moves in sliding motion toward a direction of arrow C in the drawing, i.e., mounting direction, and is inserted to the mounting unit 10. That is, the direction of insertion of the developer supplying container 1 to the mounting unit 10 is opposite to the attachment direction of the shutter 8 descried earlier to the developer supplying container 1. As illustrated in FIG. 12A, when the developer supplying container 1 is started to be inserted to the mounting unit 10, the shutter 8 is also moved along with the movement of the developer supplying container 1 in the direction of arrow C in the drawing together with the developer supplying container 1.

The mounting unit 10 has a lock claw engagement portion 9 as an engagement counterpart portion and a return contact portion 91 as a first contact portion, which are capable of abutting against the lock claw portion 8*b* of the lock portion 8*a*. The lock claw engagement portion 9 is disposed downstream than the return contact portion 91 in a mounting direction of the developer supplying container 1.

When mounting the developer supplying container 1, at first, the lock claw portion 8*b* abuts against the return contact portion 91. In this state, when the lock claw portion 8*b* abuts against the return contact portion 91, the lock claw portion 8*b* is pressed inward in the width direction (directions of arrow D and E in the drawing), and the lock portion 8*a* elastically deforms inward in the width direction. Along with the elastic deformation of the lock portion 8*a*, the lock claw portion 8*b* surpasses the return contact portion 91. The surface of the return contact portion 91 abutting against the lock claw portion 8*b* in the state where the developer supplying container 1 is being mounted is inclined, so that the lock claw portion 8*b* can easily surpass the return contact portion 91, without being caught.

Figure 12B:
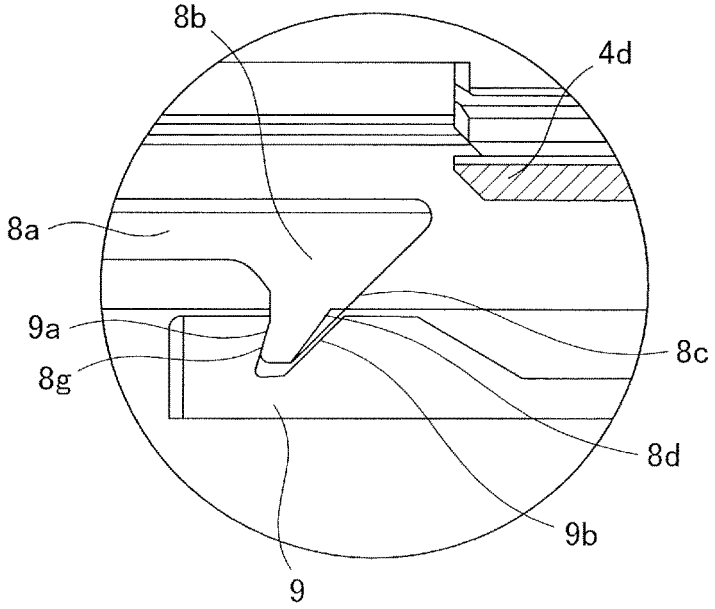
FIG. 12B is a partial enlarged view of FIG. 12A.

When the shutter 8 moves further with the developer supplying container 1, the lock claw portion 8*b* is engaged with the lock claw engagement portion 9. In that case, as shown in FIG. 12B, a stopper portion 8*g* of the lock claw portion 8*b* abuts against a first shutter stopper portion 9*a* of the lock claw engagement portion 9, and the shutter 8 is fixed to the mounting unit 10. In this state, the shutter opening 8*e* is not opposed to the outlet port 4*a*, so that the developer will not be discharged from the developer supplying container 1.

Figure 13A:
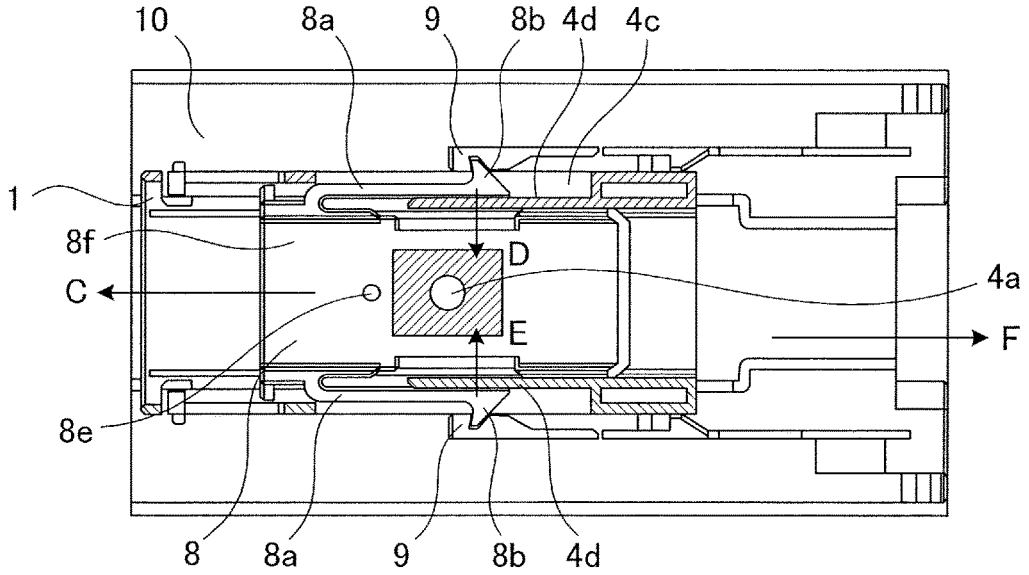
FIG. 13A is an upper view illustrating a state where the developer supplying container is in midway of attachment to the developer supplying device.

In the state where the shutter 8 is fixed to the mounting unit 10, as illustrated in FIG. 13A, only the developer supplying container 1 is moved. That is, the developer supplying container 1 and the shutter 8 are relatively moved.

Figure 13B:
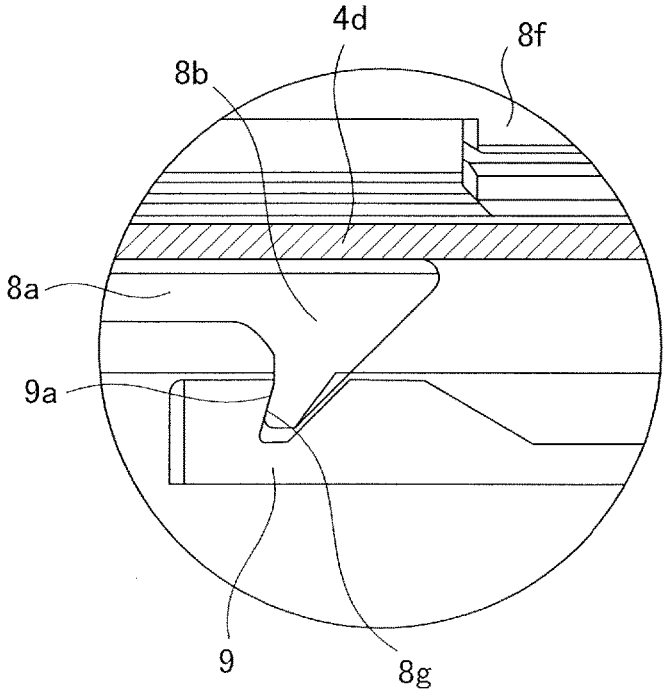
FIG. 13B is a partial enlarged view of FIG. 13A.

In the state where the developer supplying container 1 and the shutter 8 are moved relatively, a regulation rib 4*d* extending toward the direction of insertion of the developer supplying container 1 in the discharge portion 4*c* enters into a clearance formed between the lock portion 8*a* and the shielding portion 8*f*, as illustrated in FIG. 13B. In this state, the lock portion 8*a* is sandwiched by the lock claw engagement portion 9 and the regulation rib 4*d*, so that it cannot be elastically deformed, and cannot be displaced either in the direction of arrow D or the direction of arrow E in the drawing. As described, the engagement between the lock claw portion 8*b* and the lock claw engagement portion 9 is prevented from being released and the shutter 8 is prevented from moving, by regulating the lock portion 8*a*.

Figure 14A:
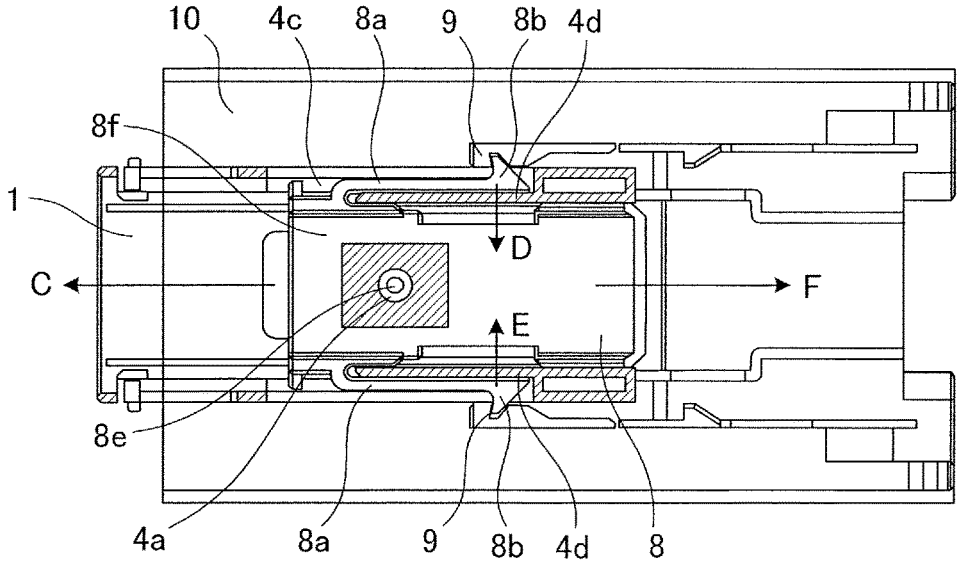
FIG. 14A is an upper view illustrating a state where the mounting of the developer supplying container to the developer supplying device is completed.
Figure 14B:
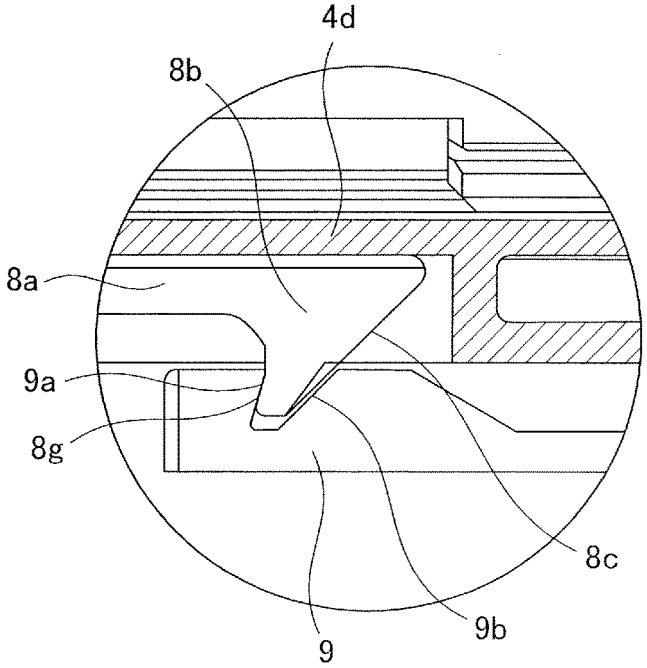
FIG. 14B is a partial enlarged view of FIG. 14A.

Along with the continuation of relative movement of the developer supplying container 1 and the shutter 8, as illustrated in FIGS. 14A and 14B, the regulation rib 4*d* abuts against the base of the lock portion 8*a* and the lock claw portion 8*b*, and further movement of the developer supplying container 1 in the direction of arrow C in the drawing is regulated. Thereby, the mounting of the developer supplying container 1 to the mounting unit 10 is in a completed state. In the present mounting completion state, the shutter opening 8*e* is opposed to the outlet port 4*a*, so that the developer can be discharged from the developer supplying container, along with the supplying operation of the reciprocating pump portion 3*a*, as described earlier.

Detachment of Developer Supplying Container

Next, the detachment operation of the developer supplying container 1 from the developer supplying device 201 will be described with reference to FIGS. 12A through 15C. The detachment operation of the developer supplying container 1 is performed by a procedure opposite to the mounting operation described above. The detachment operation refers to an operation performed until the developer supplying container 1 can be removed from the mounting unit 10.

The developer supplying container 1 moves in sliding motion in the direction of arrow F in the drawing, i.e., detachment direction, and taken out from the mounting unit 10. That is, the detachment direction of the developer supplying container 1 from the mounting unit 10 approximately matches the attachment direction of the above-described shutter 8 to the developer supplying container 1. In the mounting completed state illustrated in FIGS. 14A and 14B, the regulation rib 4*d* is inserted to the clearance between the lock portion 8*a* and the shielding portion 8*f*, so that the lock portion 8*a* is prevented from being displaced both in the arrow D direction and the arrow E direction in the drawings. Therefore, even if the developer supplying container 1 is moved in the direction of arrow F in the drawing, the engagement between the lock claw portion 8*b* and the lock claw engagement portion 9 will not be released, and the shutter 8 will not move. That is, the shutter 8 is maintained at a state being fixed to the mounting unit 10, and only the developer supplying container 1 can be moved. As described, when the developer supplying container 1 relatively moves with respect to the shutter 8, the opposing relationship between the shutter opening 8*e* and the outlet port 4*a* is cancelled, and the developer will not be discharged from the developer supplying container 1.

Further, along with the movement of only the developer supplying container 1 in the direction of arrow F in the drawing, the developer supplying container 1 and the shutter 8 passes the state illustrated in FIGS. 13A and 13B, and reaches the state illustrated in FIGS. 12A and 12B. In that case, the regulation of the lock portion 8*a* by the regulation rib 4*d* is released, and the lock portion 8*a* can be displaced both in the directions of arrow D and arrow E in the drawing.

In a case where the developer supplying container 1 is moved further toward the direction of arrow F in the drawing, as illustrated in FIG. 12B, the lock claw portion 8*b* moves along a second shutter stopper portion 9*b* of the lock claw engagement portion 9. Thereby, the lock portion 8*a* deforms elastically. Then, the engagement between the lock claw portion 8*b* and the lock claw engagement portion 9 is released, so that the shutter 8 can move together with the developer supplying container 1 in the direction of arrow F in the drawing with respect to the mounting unit 10.

In that case, the shutter 8 may not be returned to the "initial position". Then, the developer supplying container 1 may be removed from the developer supplying device 201 without the shutter 8 returning to the "initial position". This problem occurs since a frictional force, hereinafter referred to as static friction force, preventing the shutter 8 from relatively moving with respect to the moving developer supplying container 1 occurs between the mutually abutting shutter 8 and opening seal 5*a*. That is, the developer supplying container 1 and the shutter 8 move together while maintaining, by static friction force, the positional relationship between the shutter 8 and the developer supplying container 1 in the state where the engagement between the lock claw portion 8*b* and the lock claw engagement portion 9 have been released, so that the shutter 8 may not be easily returned to the "initial position". When the developer supplying container 1 with the shutter 8 not returned to the initial position is mounted again, a portion of the developer supplying container 1 or the developer supplying device 201, especially the mounting unit 10, maybe damaged, as described later (refer to FIGS. 18A and 18B described later).

Returning of Shutter to Initial Position

Figure 15A:
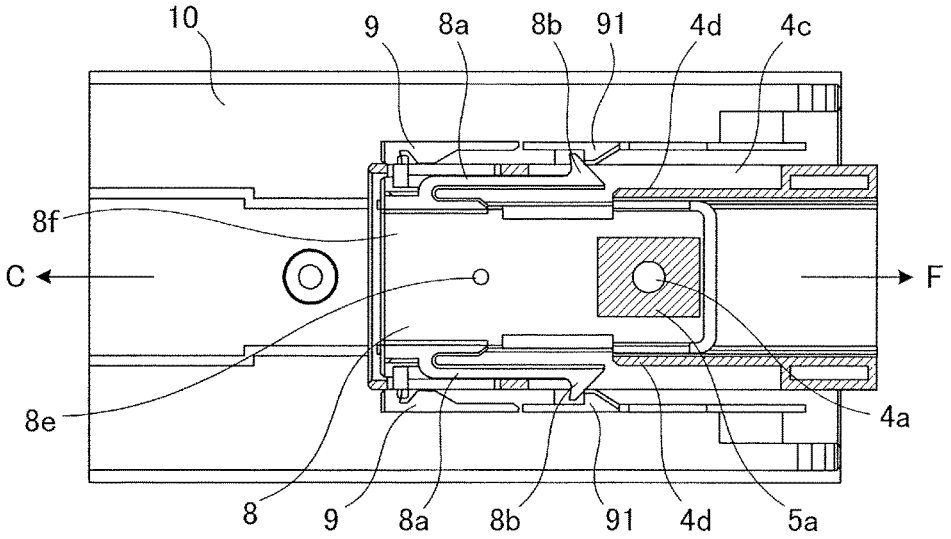
FIG. 15A is an upper view illustrating how the developer supplying container is taken out of the developer supplying device.
Figure 15B:
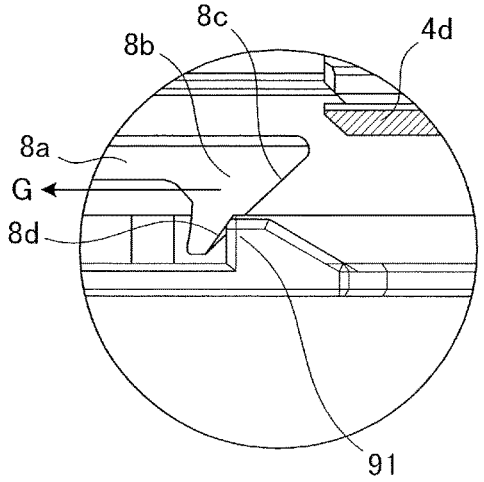
FIG. 15B is a partial enlarged view of FIG. 15A.

Therefore, in the present embodiment, an arrangement is adopted to return the shutter 8 infallibly to the initial position in a case where the developer supplying container 1 is moved from the state illustrated in FIGS. 12A and 12B further to the direction of arrow F in the drawing. This arrangement will be described with reference to FIGS. 15A through 15C. FIGS. 15A and 15B illustrate a state where the developer supplying container 1 (and the shutter 8) is moved further from the state illustrated in FIGS. 12A and 12B toward the direction of arrow F in the drawing. Also according to FIGS. 15A and 15B, the left side in the drawing is the side having the flange portion 4, and the right side in the drawing is the side having the developer storage portion 2.

Figure 15C:
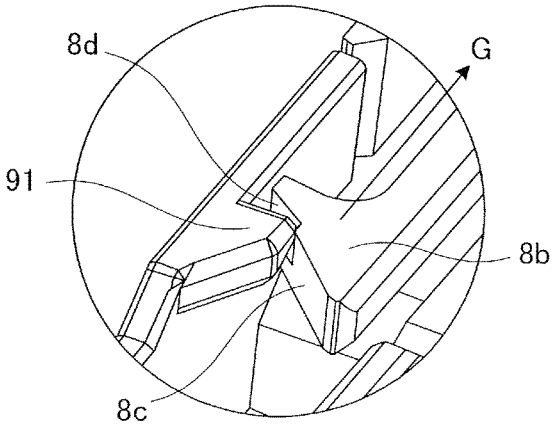
FIG. 15C is a partially enlarged perspective view of FIG. 15A.

As illustrated in FIGS. 15A through 15C, when the developer supplying container 1 is moved in the direction of arrow F in the drawing, the lock claw portion 8*b* is abutted against the return contact portion 91. However, in this case, the first inclined surface 8*d* of the lock claw portion 8*b* is abutted against the return contact portion 91. The return contact portion 91 is formed on the lock claw engagement portion 9 to be abutted only against the first inclined surface 8*d* without being abutted against the second inclined surface 8*c* of the lock claw portion 8*b*.

In a state where the lock claw portion 8*b* is abutted against the return contact portion 91, as illustrated in FIGS. 15B and 15C, the shutter 8 receives a resistance force, hereinafter referred to as a shutter returning force, in a direction opposite to the detachment direction of the developer supplying container (direction of arrow G in the drawing) via the lock portion 8*a*. The "shutter returning force" is a force capable of moving the shutter 8 relatively in an opposite direction (direction of arrow G in the drawing) with respect to the developer supplying container 1 moved in the detachment direction.

According to the present embodiment, the "shutter returning force" is greater than the "static friction force". The return contact portion 91 is provided to the lock claw engagement portion 9 and the first inclined surface 8*d* is provided to the lock claw portion 8*b*, so as to realize the above-described state. The return contact portion 91 is formed to be able to abut against only the first inclined surface 8*d*, as described above. On the other hand, the first inclined surface 8*d* is formed so that the inclination angle β is greater than the inclination angle α of the second inclined surface 8*c* (α<β, refer to FIG. 9C). That is, by providing the first inclined surface 8*d* independently as the second inclined surface 8*c* on the lock claw portion 8*b*, it becomes possible to increase the inclination angle β of the first inclined surface 8*d* as much as possible, and thereby increase the sliding resistance between the first inclined surface 8*d* and the return contact portion 91.

Since the "shutter returning force" is greater than the "static friction force", the shutter 8 is returned to the "initial position" along with the movement of the developer supplying container 1, even if the shutter 8 is not returned to the "initial position" when the engagement between the lock claw portion 8*b* and the lock claw engagement portion 9 is released. In other words, the shutter 8 is moved toward an opposite direction as the developer supplying container 1 by the "shutter returning force" (direction of arrow G in the drawing). Then, the shutter 8 is moved to the "initial position" until the shutter 8 abuts against the opposing portion 4*f* (refer to FIG. 7A) of the protection cover 4*e*. As described earlier, when the opposing portion 4*f* is abutted against one end portion of the shutter 8, the shutter opening 8*e* is not opposed to the outlet port 4*a*, and the shielding portion 8*f* is opposed to the outlet port 4*a*. After returning to the "initial position", the shutter 8 moves together with the developer supplying container 1 by being pushed via the opposing portion 4*f* of the protection cover 4*e*. Therefore, when the developer supplying container 1 is taken out of the developer supplying device 201, the shutter 8 has returned infallibly to the "initial position".

COMPARATIVE EXAMPLE

Figure 16A:
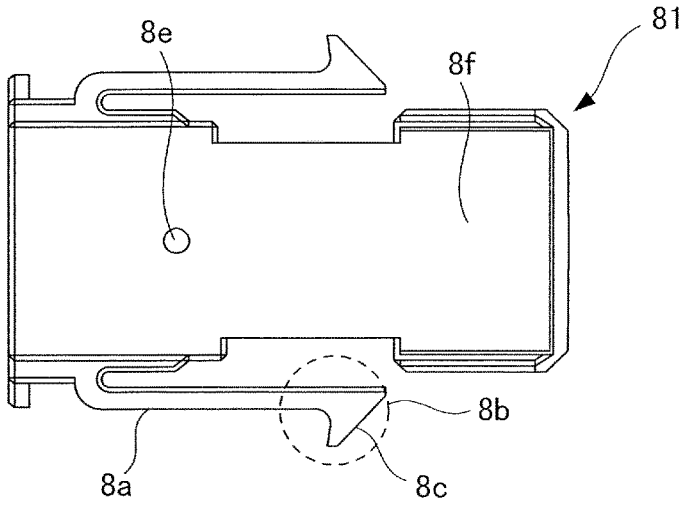
FIG. 16A is an upper view illustrating a shutter of a comparative example.
Figure 16B:
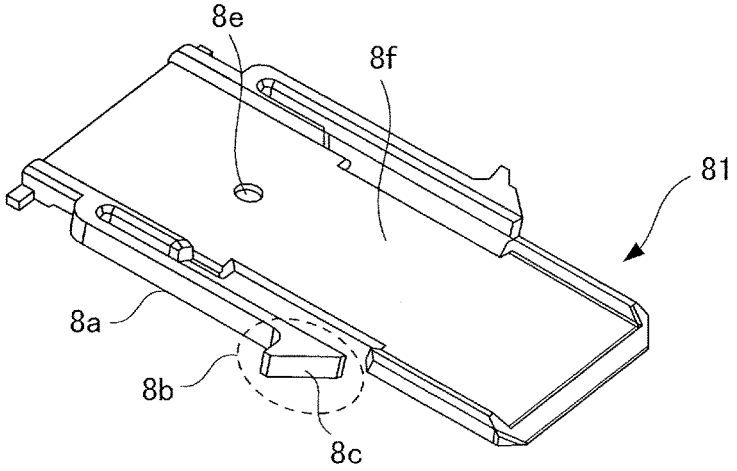
FIG. 16B is an outer perspective view of the comparative example.
Figure 16C:
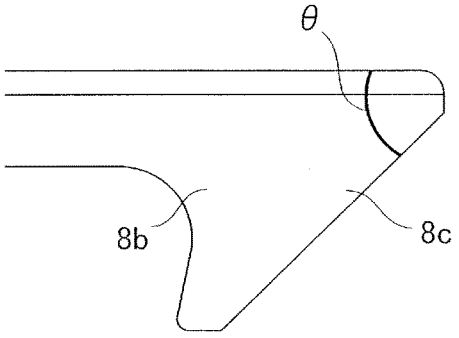
FIG. 16C is an enlarged view of a lock claw portion of the comparative example.
Figure 17A:
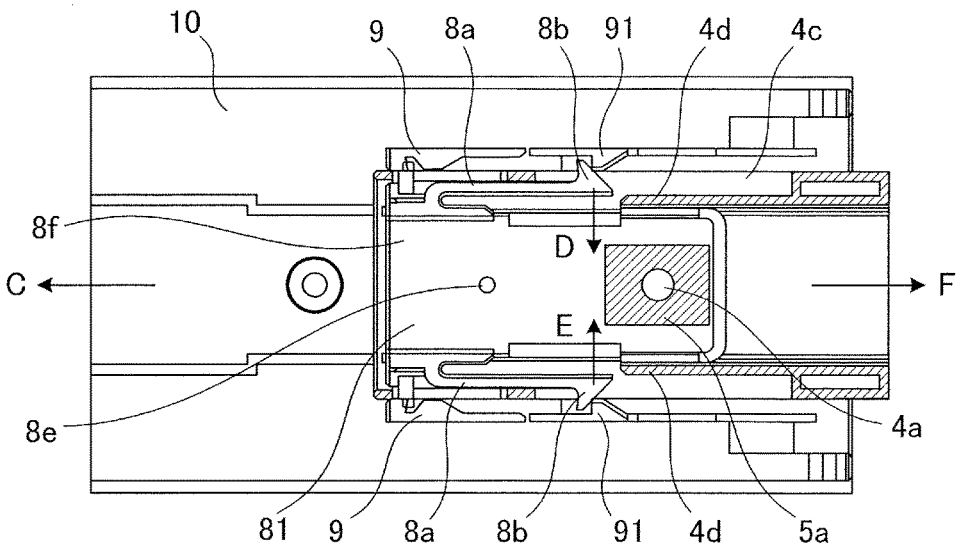
FIG. 17A is an upper view illustrating an operation of how the developer supplying container adopting the shutter of the comparative example is taken out of the developer supplying device.
Figure 17B:
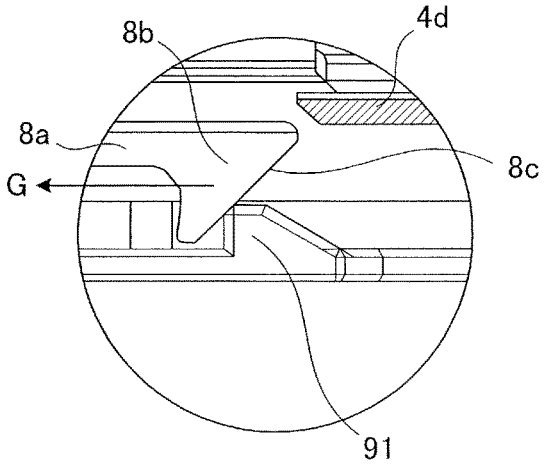
FIG. 17B is a partial enlarged view of FIG. 17A.
Figure 17C:
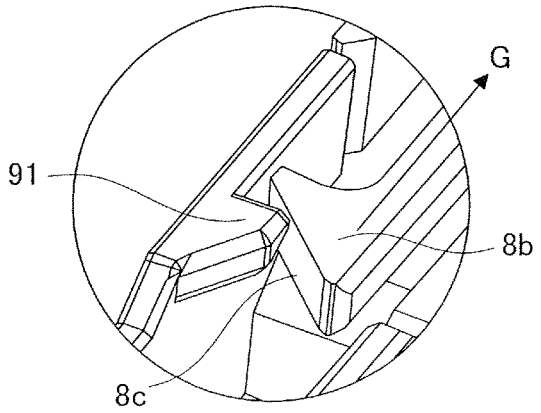
FIG. 17C is a partial enlarged perspective view of FIG. 17A.
Figure 18A:
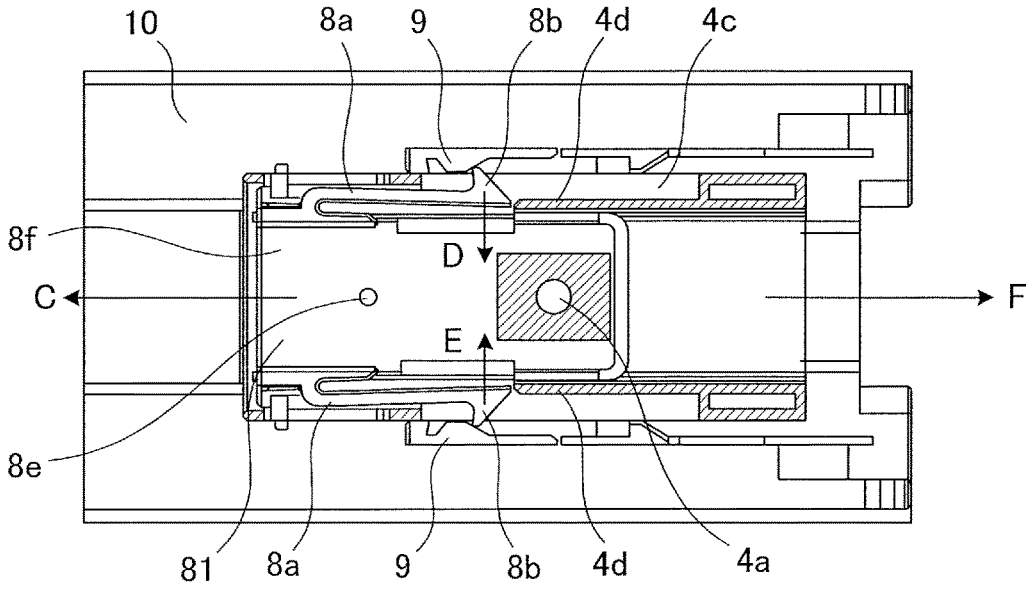
FIG. 18A is an upper view illustrating an operation of re-mounting the developer supplying container adopting the shutter of the comparative example to the developer supplying device.
Figure 18B:
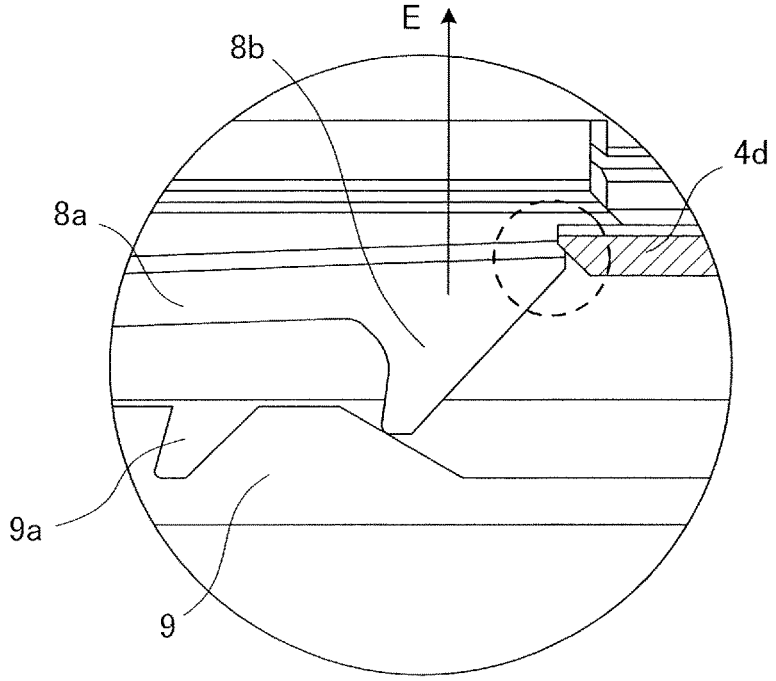
FIG. 18B is a partial enlarged view of FIG. 18A.

Now, the present embodiment is compared with a comparative example. FIGS. 16A through 18B are provided to describe the comparative example. FIG. 16A is an upper view illustrating a shutter of the comparative example, FIG. 16B is an outer perspective view, and FIG. 16C is an enlarged view of a lock claw portion. FIG. 17A is an upper view illustrating how a developer supplying container adopting the shutter of the comparative example is taken out from a developer supplying device, FIG. 17B is a partial enlarged view, and FIG. 17C is a partial enlarged perspective view. FIG. 18A is an upper view illustrating how the developer supplying container adopting the shutter of the comparative example is re-mounted to the developer supplying device, and FIG. 18B is a partial enlarged view. The only difference between the present embodiment and the comparative example is the presence of the first inclined surface 8*d* of the lock claw portion 8*b*, as described later, so that the same components are denoted with the same reference numbers, and descriptions thereof are omitted.

As can be recognized through comparison of the comparative example illustrated in FIGS. 16A through 16C and the present embodiment illustrated in FIGS. 9A through 9C, the shutter 81 of the comparative example does not have the first inclined surface 8*d* formed to the lock claw portion 8*b*, and only the second inclined surface 8*c* is formed thereto. An inclination angle θ of the second inclined surface 8*c* should be as small as possible to realize smooth shutter attachment, but should be as large as possible to return the shutter infallibly to the initial position. However, if only one second inclined surface 8*c* is formed on the lock claw portion 8*b*, as illustrated in the comparative example, the inclination angle θ must be decided by specializing on either smooth "shutter attachment" or reliable "return of the shutter to the initial position".

When only the second inclined surface 8*c* is formed specializing on "shutter attachment" and designing the inclination angle θ to be an inclination angle α which is as small as possible (<inclination angle β), the "return of the shutter to the initial position" is not realized preferably. That is, when the developer supplying container 1 is moved to the direction of arrow F in the drawing, as illustrated in FIGS. 17A through 17C, the lock claw portion 8*b* abuts against the return contact portion 91. In that case, the second inclined surface 8*c* of the lock claw portion 8*b* is abutted against the return contact portion 91. If the lock claw portion 8*b* is abutted against the return contact portion 91, the shutter 81 receives a "shutter returning force" in a direction (direction of arrow G in the drawing) opposite from the detaching direction (direction of arrow F in the drawing) of the developer supplying container 1 through the lock portion 8*a*.

However, in a case where the second inclined surface 8*c* is formed to have a small inclination angle α, the "shutter returning force" received by the shutter 81 becomes small compared to the case where the shutter is formed with a large inclination angle β. In that case, there is fear that the "shutter returning force" may not become greater than the above-mentioned "static friction force". If the "shutter returning force" is smaller than the "static friction force", the shutter 81 will not be moved in a direction (direction of arrow G in the drawing) opposite from the developer supplying container 1. Therefore, if the shutter 81 is not returned to the "initial position" when the engagement between the lock claw portion 8*b* and the lock claw engagement portion 9 is released, the developer supplying container 1 will be taken out of the developer supplying device 201 in a state where the shutter 81 is not placed at the "initial position".

If the developer supplying container 1 with the shutter 81 not positioned at the initial position is re-mounted, the developer supplying container 1 or the mounting unit 10 and the like may be damaged. This point will be described with reference to FIGS. 18A and 18B.

As can be recognized by comparison with the example illustrated in FIGS. 12A and 12B, if the shutter 81 is not at the initial position, the lock claw portion 8*b* will not be engaged with the lock claw engagement portion 9, and may easily be in a state sandwiched between the lock claw engagement portion 9 and the regulation rib 4*d*. That is, a gap or clearance is ensured between the lock claw engagement portion 9 of the mounting unit 10 and the regulation rib 4*d* of the discharge portion 4*c*, allowing the lock portion 8*a* to be passed while being displaced in the direction of arrow D in the drawing and the direction of arrow E in the drawing, along with the movement of the developer supplying container 1. In a case where the shutter 81 is at the initial position, the lock claw portion 8*b* can easily pass through the clearance between the lock claw engagement portion 9 and the regulation rib 4*d*, sliding against the lock claw engagement portion 9.

On the other hand, if the shutter 81 is not at the initial position, the shutter 81 is positioned closer to the developer storage portion 2 than at the initial position. Therefore, a clearance capable of allowing the movement of the lock claw portion 8*b* cannot be ensured between the lock claw portion 8*b* and the regulation rib 4*d* when the lock claw portion 8*b* passes the space between the lock claw engagement portion 9 and the regulation rib 4*d*. Then, the lock claw portion 8*b* interferes with the regulation rib 4*d*, and the lock claw portion 8*b* is caught between the lock claw engagement portion 9 and the regulation rib 4*d*. In that case, the shutter 81 cannot move in the direction of insertion of the developer supplying container 1 (direction of arrow C in the drawing), and further mounting of the developer supplying container 1 becomes difficult. If the developer supplying container 1 is pushed in with force, the developer supplying container 1 or the mounting unit 10 and the like may be damaged.

When only the second inclined surface 8*c* is formed specializing on "return of the shutter to the initial position" and designing the inclination angle θ to be a greatest possible inclination angle β (>inclination angle α), the "shutter attachment" is not realized preferably. As described (refer to FIGS. 11A through 11C), when the shutter 8 is inserted to the developer supplying container 1, the lock portion 8*a* is elastically deformed along with the abutment of the lock claw portion 8*b* against the attachment contact portion 4*b*, and the lock claw portion 8*b* surpasses the attachment contact portion 4*b*. Now, when the second inclined surface 8*c* is formed with a large inclination angle β, the force required for the lock claw portion 8*b* to surpass the attachment contact portion 4*b* is increased compared to the case where the surface 8*c* is formed with a small inclination angle α. Therefore, the shutter 8 may be inserted forcibly to the developer supplying container 1, and as a result, the lock claw portion 8*b* may be damaged.

In contrast, according to the present embodiment, two inclined surfaces, which are the second inclined surface 8*c* and the first inclined surface 8*d*, are provided to the lock claw portion 8*b* of the lock portion 8*a*. According to such arrangement, the second inclined surface 8*c* should be formed with a smallest possible inclination angle α (smaller than the inclination angle β) so as to realize a smooth "shutter attachment". At the same time, the first inclined surface 8*d* should be formed with a greatest possible inclination angle β (greater than the inclination angle α) to realize a reliable "return of the shutter to the initial position". In the present embodiment, since two different inclined surfaces are provided on the lock claw portion 8*b*, the inclination angle α corresponding to "shutter attachment" and the inclination angle β corresponding to "return of the shutter to the initial position" can be set at the same time.

As described, according to the present embodiment, both the "shutter attachment" and "return of the shutter to the initial position" can be realized through a simple configuration. Further, the inclination angle of the inclined surface is not required to be set within a limited range, and the inclined surface with a different inclination angle can easily be formed, so that a high-quality developer supplying container realizing both "shutter attachment" and "return of the shutter to the initial position" can be provided.

Other Embodiments

The developer supplying container 1 according to the present embodiment may be a developer supplying container 1 not having the pump portion 3*a*. In this case, the configurations other than the pump portion 3*a* can be the same, and as for the conveyance of the developer within the developer supplying container 1, the developer can be conveyed via the cylindrical portion 2*k* and the conveyance member 6 to the discharge portion 4*c*. However, if the pump portion 3*a* is not provided, forcible discharge operation of the developer caused by pressure variation may not be performed. Therefore, the diameter of the outlet port 4*a* should be set large enough for the developer to be discharged sufficiently by gravity. As described, even in the developer supplying container 1 without a pump portion 3*a*, both the "shutter attachment" and "return of the shutter to the initial position" can be realized by providing two inclined surfaces, which are the second inclined surface 8*c* and the first inclined surface 8*d*, to the lock claw portion 8*b* of the lock portion 8*a*.

In the above-described embodiment, the developer supplying container 1 was described as an example of the developer storing container, but the storing container is not restricted thereto. For example, it can be a developing unit 800 having a stirring chamber to which the developer is supplied and a developing chamber supplying the developer to the developing sleeve 800*a* (refer to FIG. 5). However, although not shown in the drawing, an outlet port through which excessive developer can be discharged is provided to the developing unit 800, and a shutter capable of being opened and closed is attached to the outlet port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-169916, filed Aug. 31, 2015, which is hereby incorporated by reference herein in its entirety.

What is claimed is:

1. A developer supplying container detachably mountable to a developer supplying apparatus, the developer supplying container comprising:

a rotatable storage portion configured to store developer;

an opening configured to discharge the developer in the storage portion;

a shutter movable relative to the opening in a direction of a rotational axis of the storage portion so as to open and close the opening;

a supporting portion configured to support the shutter;

an insertion opening provided on the supporting portion, the insertion opening being configured to insert the shutter into the supporting portion in an inserting direction of the shutter;

an engagement portion, provided on the shutter, configured to be capable of displacement in a width direction intersecting the rotational axis, a part of the engagement portion being outside of the supporting portion in the width direction;

a first inclined surface provided on the part of the engagement portion and inclining such that a portion on a downstream side in the inserting direction of the shutter is located closer to the shutter in the width direction than a portion on an upstream side in the inserting direction, the first inclined surface being configured to engage to move the shutter in a direction opposite to the inserting direction in a case that the developer supplying container is dismounted from the developer supplying apparatus; and a second inclined surface provided the engagement portion in the width direction and inclining such that a portion on a downstream side in the inserting direction is located closer to the shutter in the width direction than a portion on an upstream side in the inserting direction, the second inclined surface having an angle with respect to the inserting direction smaller than an angle of the first inclined surface, and the second inclined surface being configured to engage in a case that the shutter is inserted into the supporting portion in the inserting direction.

2. The developer supplying container according to claim 1, wherein the shutter has a plate-like shape, and the first inclined surface and the second inclined surface are arranged side by side in a thickness direction of the shutter.

3. The developer supplying container according to claim 2, wherein the second inclined surface is arranged on a storage portion side of the first inclined surface.

4. The developer supplying container according to claim 1, wherein the first inclined surface is arranged upstream of the second inclined surface in the inserting direction.

5. The developer supplying container according to claim 1, wherein the first inclined surface is provided to a concave portion recessed in a direction opposite to the inserting direction at a position of the second inclined surface.

6. The developer supplying container according to claim 1, wherein the shutter has a communication port communicating with the opening.

7. A developer supplying system comprising a developer receiving device, and a developer supplying container capable of being attached to and detached from the developer receiving device, the developer receiving device comprising:

a mounting unit configured to mount the developer supplying container;

a developer receiving portion configured to receive developer;

a developer supplying container insertion opening through which the developer supplying container is inserted into the developer receiving device; and a contact portion located more downstream in a detaching direction of the developer supplying container than the developer receiving portion, wherein the developer supplying container comprises:

a rotatable storage portion configured to store developer, an opening configured to discharge the developer in the storage portion toward the developer receiving portion, a shutter movable relative to the opening in a direction of a rotational axis of the storage portion so as to open and close the opening, a supporting portion configured to support the shutter, an insertion opening provided on the supporting portion and through which the shutter is inserted into the supporting portion in an inserting direction of the shutter, an engagement portion, provided on the shutter, configured to be capable of displacement in a width direction intersecting the rotational axis, a part of the engagement portion being outside of the supporting portion in the width direction, a first inclined surface provided on the part of the engagement portion and inclining such that a portion on a downstream side in the inserting direction of the shutter is located closer to the shutter in the width direction than a portion on an upstream side in the inserting direction, the first inclined surface being configured to engage with the contact portion to move the shutter in a direction opposite to the inserting direction in a case that the developer supplying container is dismounted from the developer receiving device, a second inclined surface provided on the engagement portion and inclining such that a portion on a downstream side in the inserting direction is located closer to the shutter in the width direction than a portion on an upstream side in the inserting direction, the second inclined surface having an angle with respect to the inserting direction smaller than the angle of the first inclined surface, and the second inclined surface being configured to engage in a case that the shutter is inserted into the supporting portion in the inserting direction.

8. The developer supplying system according to claim 7, wherein the shutter has a plate-like shape, and the first inclined surface and the second inclined surface are arranged side by side in a thickness direction of the shutter.

9. The developer supplying system according to claim 8, wherein the second inclined surface is arranged on a storage portion side of the first inclined surface.

10. The developer supplying system according to claim 7, wherein the first inclined surface is arranged upstream of the second inclined surface in the inserting direction.

11. The developer supplying system according to claim 7, wherein the first inclined surface is provided to a concave portion recessed in a direction opposite to the inserting direction at a position of the second inclined surface.

12. The developer supplying system according to claim 7, wherein the shutter has a communication port communicating with the opening.

13. The developer supplying system according to claim 7, further comprising a seal member provided in a circumference of the opening of the developer supplying container, the seal member being configured to seal a clearance between the developer supplying container and the shutter, wherein, in a state where the first inclined surface and the contact portion are abutted against one another, along with an operation of drawing out the developer supplying container the engagement portion applies a resistance force between the first inclined surface and the contact portion, the resistance force being greater than a static friction force generated between the shutter and the seal member and preventing the shutter from relatively moving in a direction opposite from the detaching direction with respect to the developer supplying container, and relatively moving the shutter in the opposite direction with respect to the developer supplying container.

14. The developer supplying system according to claim 7, wherein the developer receiving device comprises an engaged portion provided downstream, in a mounting direction of the developer supplying container, of the contact portion, the engaged portion being configured to engage with the engagement portion in a state where the developer supplying container is mounted, and the engaged portion retaining the shutter at a position opening the opening portion, and wherein the engaged portion is configured such that in a state where the developer supplying container is drawn out, an engagement of a portion of the second inclined surface abuts against the engaged portion and the engaged portion is released, and the engagement portion moves in the detaching direction, and thereafter, the first inclined surface abuts against the contact portion along with the movement of the developer supplying container in the detaching direction.

* * * * *